US005947465A

United States Patent [19]

Kato et al.

[11] Patent Number: 5,947,465

[45] Date of Patent: Sep. 7, 1999

[54] SHEET-SUPPLY DEVICE HAVING A DRIVE FORCE TRANSMISSION MECHANISM

[75] Inventors: Hiroyuki Kato, Nagoya; Akira Sago, Seto, both of Japan

[73] Assignee: Brother Kogyo Kabushiki Kaisha, Nagoya, Japan

[21] Appl. No.: 08/769,277

[22] Filed: Dec. 18, 1996

[30] Foreign Application Priority Data

| | | | |
|---|---|---|---|
| Dec. 20, 1995 | [JP] | Japan | 7-349605 |
| Dec. 22, 1995 | [JP] | Japan | 7-350600 |
| Dec. 22, 1995 | [JP] | Japan | 7-350601 |
| Apr. 26, 1996 | [JP] | Japan | 8-106848 |
| Apr. 30, 1996 | [JP] | Japan | 8-108927 |

[51] Int. Cl.[6] ..... B65H 5/00

[52] U.S. Cl. ..... 271/10.11; 271/10.12; 271/114; 271/242

[58] Field of Search ..... 271/10.04, 10.05, 271/10.11, 10.12, 10.13, 114, 242, 902

[56] References Cited

U.S. PATENT DOCUMENTS

| | | | |
|---|---|---|---|
| 5,222,724 | 6/1993 | Hirano et al. | 271/10.11 |
| 5,697,603 | 12/1997 | Kato | 271/10.12 X |

FOREIGN PATENT DOCUMENTS

| | | | |
|---|---|---|---|
| 215437 | 9/1987 | Japan | 271/114 |
| A-6-271112 | 9/1994 | Japan . | |
| A-7-81766 | 3/1995 | Japan . | |

*Primary Examiner*—Boris Milef
*Attorney, Agent, or Firm*—Oliff & Berridge, PLC

[57] ABSTRACT

A sheet-supply device for supplying a sheet from a stack of sheets to a print mechanism, the sheet supply device including: a sheet-feed roller for feeding the sheet in a sheet-feed direction; a rotatable transport roller disposed downstream from the sheet-feed roller in the sheet-feed direction; a drive source for generating a drive force by rotating in a forward rotational direction to rotate the transport roller in a sheet-transport rotational direction for transporting the sheet away from the sheet-feed roller and a reverse rotational direction to rotate the transport roller in a reverse sheet-transport rotational direction opposite the sheet-transport rotational direction; a drive force transmission mechanism for transmitting drive force from the drive source to the sheet-feed roller to rotate the sheet-feed roller in the sheet-feed rotational direction, the drive force transmission mechanism interrupting transmission of drive force from the drive source to the sheet-feed roller for a short period when the drive force switches from its reverse rotational direction to its forward rotational direction and for a long period longer than the short period when the drive force switches from its forward rotational direction to its reverse rotational direction.

15 Claims, 19 Drawing Sheets

FIG. 2 (a)
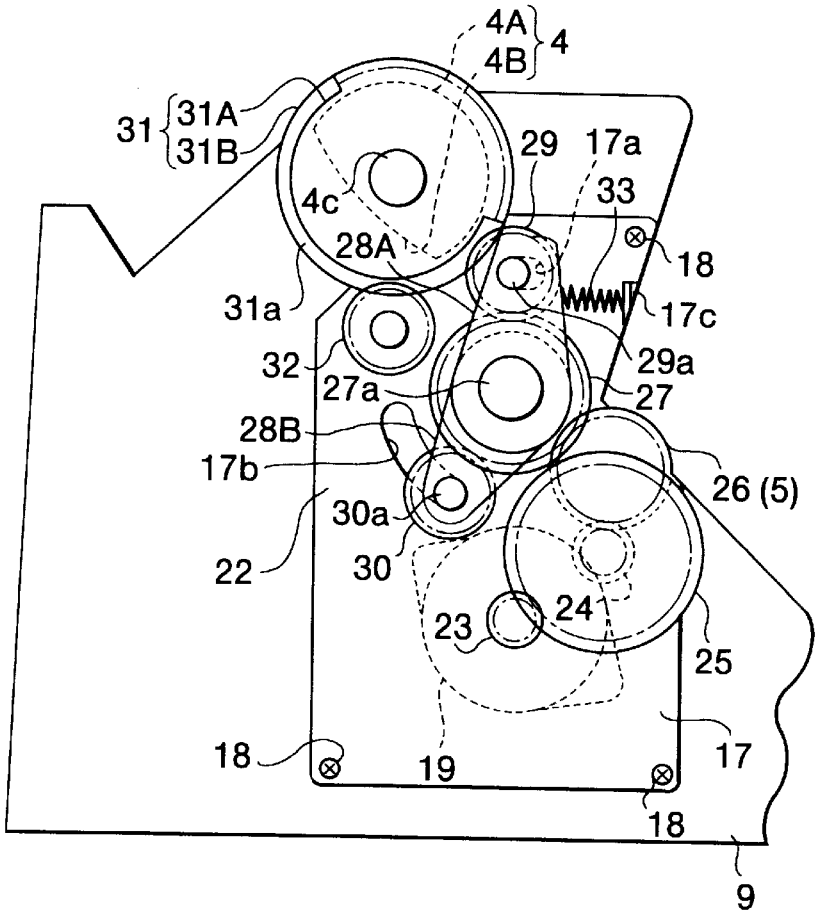
FIG. 2 (b)
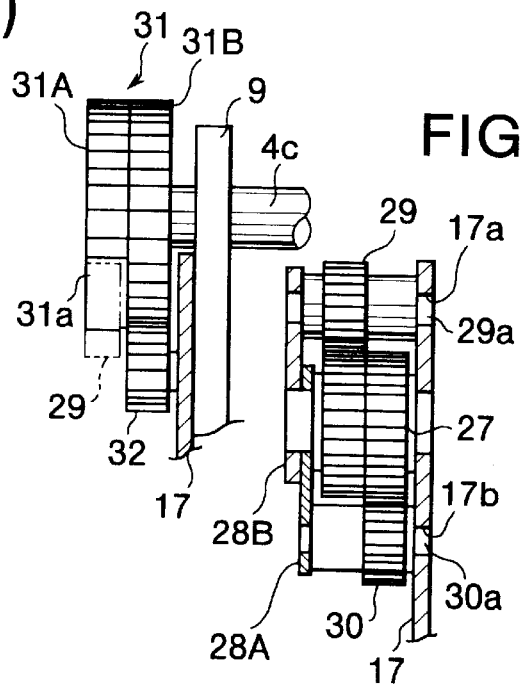
FIG. 2 (c)

SHEET-SUPPLY DEVICE HAVING A DRIVE FORCE TRANSMISSION MECHANISM

BACKGROUND OF THE INVENTION

1. Field of the Invention

The present invention relates to a sheet-supply device having a sheet-feed roller for feeding, one at a time, print sheets stacked in a hopper toward a transport roller.

2. Description of the Related Art

There has been known a sheet-feed device including a sheet-feed roller for feeding, toward a transport roller, one sheet at a time from sheets stacked in a hopper. The sheet-feed roller continues rotating until the transport roller picks up the front edge of the fed sheet. Then, the sheet-feed roller stops rotating. Further rotation of the transport roller draws the portion of the sheet remaining in the hopper out of the hopper and transports the sheet toward a print head.

While the transport roller draws the sheet from the hopper, the sheet might fold up or bend and contact the sheet-feed roller. The sheet-feed roller might rotate as a result. When the sheet-feed roller rotates while in its stopped condition in this way, the position of the sheet-feed roller can shift, which makes it difficult to feed subsequent sheets by a predetermined desired amount.

Japanese Laid-Open Patent Publication No. HEI-7-81786 describes an automatic sheet-feed device for ensuring that subsequent sheets can be fed by a desired amount and for preventing two print sheets from being fed at the same time.

Japanese Laid-Open Patent Application No. HEI-7-81786 discloses a sheet-supply device using a sheet-feed roller to feed print sheets one at a time from a hopper containing a plurality of print sheets toward a transport roller, such as a platen roller. The sheet-supply device includes a step motor serving as a rotational drive force source for driving the transport roller; and a drive force transmission mechanism including gears for transmitting rotational drive force from the step motor to the sheet-feed roller. The step motor is capable of selectively driving the transport roller in a forward rotational direction, in which print sheets are transported downstream, or in a reverse rotational direction, in which print sheets are transported upstream. When supplying print sheets using the above-described sheet-feed device, the step motor is first rotated in the reverse rotational direction by a predetermined number of steps to rotate the sheet-feed roller in a sheet-feed direction, whereupon a print sheet is fed to the platen roller. Then, the rotational direction of the step motor is switched to the forward rotational direction. This changes engagement of gears in the drive force transmission mechanism so that the sheet-feed roller and the platen roller are both rotated in the sheet-feed direction.

The device also includes a fixing means for fixing the stopped position of the sheet-feed roller at a predetermined position, with respect to the sheet-feed direction, after the sheet-feed roller is rotated by a predetermined angular amount. The fixing means includes an engagement portion provided to the sheet-feed roller and an arm engageble with the engagement portion. When transmission of drive force to the sheet-feed roller is interrupted, the arm engages in the engagement portion, thereby fixing the sheet-feed roller so it can not be rotated by contact with the sheet. When the sheet-feed roller is rotated in the opposite direction, engagement between the engagement portion and the arm is released.

The sheet-feed roller has one section of its periphery flattened so that it has a substantially half-circle shape in cross section. The curved portion contacts the sheet when the sheet-feed roller feeds a sheet toward the transport roller. The flattened portion confronts but does not contact the sheet when the sheet-feed roller is in its stopped condition.

There has been known a device wherein the sheet supplied by the sheet-feed roller is positioned or aligned by abutting its front edge against the platen roller so that the sheet bends upward.

SUMMARY OF THE INVENTION

With the configuration disclosed in Japanese Laid-Open Patent Application No. HEI-7-81786, transmission of rotational force to the sheet-feed roller is interrupted while rotational direction of the step motor is being switched. That is, there will be a time when neither the first or second planetary gear is engaged with the sheet-feed gear when, in association with the step motor switching from rotating in the reverse direction to rotating in the forward direction, driving connection between the second planetary gear and the sheet-feed gear is released and between the first planetary gear and the sheet-feed roller gear is engaged.

Because the rotational direction is switched during sheet supply, engagement between gears of the drive force transmission mechanism must be switched smoothly and quickly with switching of the rotational direction of the step motor. Otherwise, the sheet-feed gear, and consequently the sheet-feed roller, will not be rotated at a fixed timing so that sheet-feed can not be performed properly.

In the device wherein the sheet supplied by the sheet-feed roller is positioned or aligned by abutting its front edge against the platen roller so that the sheet bends upward, when the gears of the drive force transmission mechanism are disengaged for a long period, the sheet-feed roller can be pushed in the reverse rotational direction by stiffness of the print sheet, so that the bend in the print sheet flattens back out. In this case, the print sheets will not be properly positioned or aligned.

Also, when a subsequent sheet supply is started after finishing a previous sheet supply, the platen roller needs to be switched from the forward rotational direction to the reverse rotational direction by changing the engagement of the drive force transmission gears. To print enlarged characters, some printers receive, from a host computer, data for the lower half of the characters first and print the lower half before receiving data for the upper half. In this case, the transport roller must be capable of rotating in the reverse rotational direction precisely by a predetermined amount.

Smooth switching of engagement between gears of the drive force transmission means can conceivably be achieved by shortening the distance between the gears. However, when the transport roller is rotated in the reverse rotational direction to feed a subsequent sheet, the drive force will also be transmitted to the sheet-feed roller. When the sheet-feed roller rotates with the transport roller, feed of the subsequent sheet will be obstructed. Therefore, some delay is inevitable in switching of engagement between gears of the drive force transmission mechanism described in Japanese Laid-Open Patent Publication No. HEI-7-81786.

Further, with the configuration described in Japanese Laid-Open Patent Publication No. HEI-7-81786, the sheet-feed roller can be rotated in the direction for releasing engagement between the engagement portion and the arm. Therefore, the sheet-feed roller can be rotated in the direction for releasing engagement between the arm and the engagement portion by vibration and the like accompanying use or operation of the mechanism, for example, a printer, in which the sheet supply devices used. Also, the curved portion of the sheet-feed roller is above the flattened portion when the sheet-feed roller is in its stopped condition. In other words, the center of gravity of the sheet-feed roller will be above the rotational center of the sheet-feed roller. Therefore, the sheet-feed roller will tend to rotate in the direction for releasing engagement between the arm and the engagement portion by its own weight.

Even if the sheet-feed roller rotates the same amount in one full rotation, if the stopped position of the sheet-feed roller changes, the feed amount of the sheet and the timing from when transmission of drive force starts to when sheet-feed starts can vary. It is desirable to provide a mechanism wherein the sheet-feed roller can feed sheets by a more stable amount.

It is an objective of the present invention to overcome the above-described problems and to provide a sheet-feed roller device wherein the rotational direction of the drive force source is switched from a reverse rotational direction to a forward rotational direction during sheet-supply and wherein the period when rotation of the sheet-feed roller and of reversibly rotating the transport roller can be shortened.

To achieve the above-described objectives, a sheet-supply device according to the present invention for supplying a sheet from a stack of sheets to a print mechanism, includes: a sheet-feed roller for feeding the sheet in a sheet-feed direction; a rotatable transport roller disposed downstream from the sheet-feed roller in the sheet-feed direction; a drive source for generating a drive force by rotating in a forward rotational direction to rotate the transport roller in a sheet-transport rotational direction for transporting the sheet away from the sheet-feed roller and a reverse rotational direction to rotate the transport roller in a reverse sheet-transport rotational direction opposite the sheet-transport rotational direction; a drive force transmission mechanism for transmitting drive force from the drive source to the sheet-feed roller to rotate the sheet-feed roller in the sheet-feed rotational direction, the drive force transmission mechanism interrupting transmission of drive force from the drive source to the sheet-feed roller for a short period when the drive force switches from its reverse rotational direction to its forward rotational direction and for a long period longer than the short period when the drive force switches from its forward rotational direction to its reverse rotational direction.

According to another aspect of the present invention, a sheet-supply device includes: a sheet-feed roller for feeding a sheet from a stack of sheets; a drive source for generating drive force to be transmitted to the sheet-feed roller; a drive force transmission mechanism including a sheet-feed gear connected to rotate with the sheet-feed roller, the drive force transmission mechanism selectively transmitting and interrupting transmission of drive force from the drive source to the sheet-feed gear; and an urging means abutting a side surface of the sheet-feed gear and for supporting the sheet-feed roller in a stopped condition.

According to still another aspect of the present invention, a sheet-supply device includes: a sheet-feed roller for feeding a sheet from a stack of sheets; a transport roller for disposed downstream from the sheet-feed roller in a sheet-feed direction; a rotation type drive source capable of forward and reverse rotation; a sun gear driven by the drive source; a sheet-feed gear drivingly connected with the sheet-feed roller; a first planetary gear drivingly connected with the sheet-feed gear by forward rotation of the drive source; a second planetary gear drivingly connected with the sheet-feed gear by reverse rotation of the drive source; and urging means for urging the sheet-feed roller in a sheet-feed direction when driving connection between the second planetary gear and the sheet-feed gear is released in association with switching of rotational direction of the drive source from reverse rotational direction to forward rotational direction.

BRIEF DESCRIPTION OF THE DRAWINGS

The above and other objects, features and advantages of the invention will become more apparent from reading the following description of the preferred embodiment taken in connection with the accompanying drawings in which:

FIG. 2(*a*) is a side view showing the sheet-feed device of the first embodiment;

FIG. 2(*b*) is a side view showing details of a sheet-feed roller gear in the sheet-feed device of FIG. 2(*a*);

FIG. 2(*c*) is a side view showing details of a sun gear in the sheet-feed device of FIG. 2(*a*);

FIG. 20(*b*) is a cross-sectional view showing the spring member bending and riding over an engagement protrusion portion formed on the sheet-feed roller gear;

FIG. 20(*c*) is a cross-sectional view showing the spring member engaged in an engagement indentation portion, formed between engagement protrusion portions of the sheet-feed roller gear;

FIG. 21(*b*) is a cross-sectional view showing the spring member abutting against the engagement protrusion portions of the sheet-feed roller gear when the sheet-feed roller gear rotates in the reverse rotational direction;

FIG. 23(*b*) is a side view showing details of a sheet-feed roller gear in the sheet-feed device of FIG. 23 (*a*);

DETAILED DESCRIPTION OF THE PREFERRED EMBODIMENTS

Figure 1:
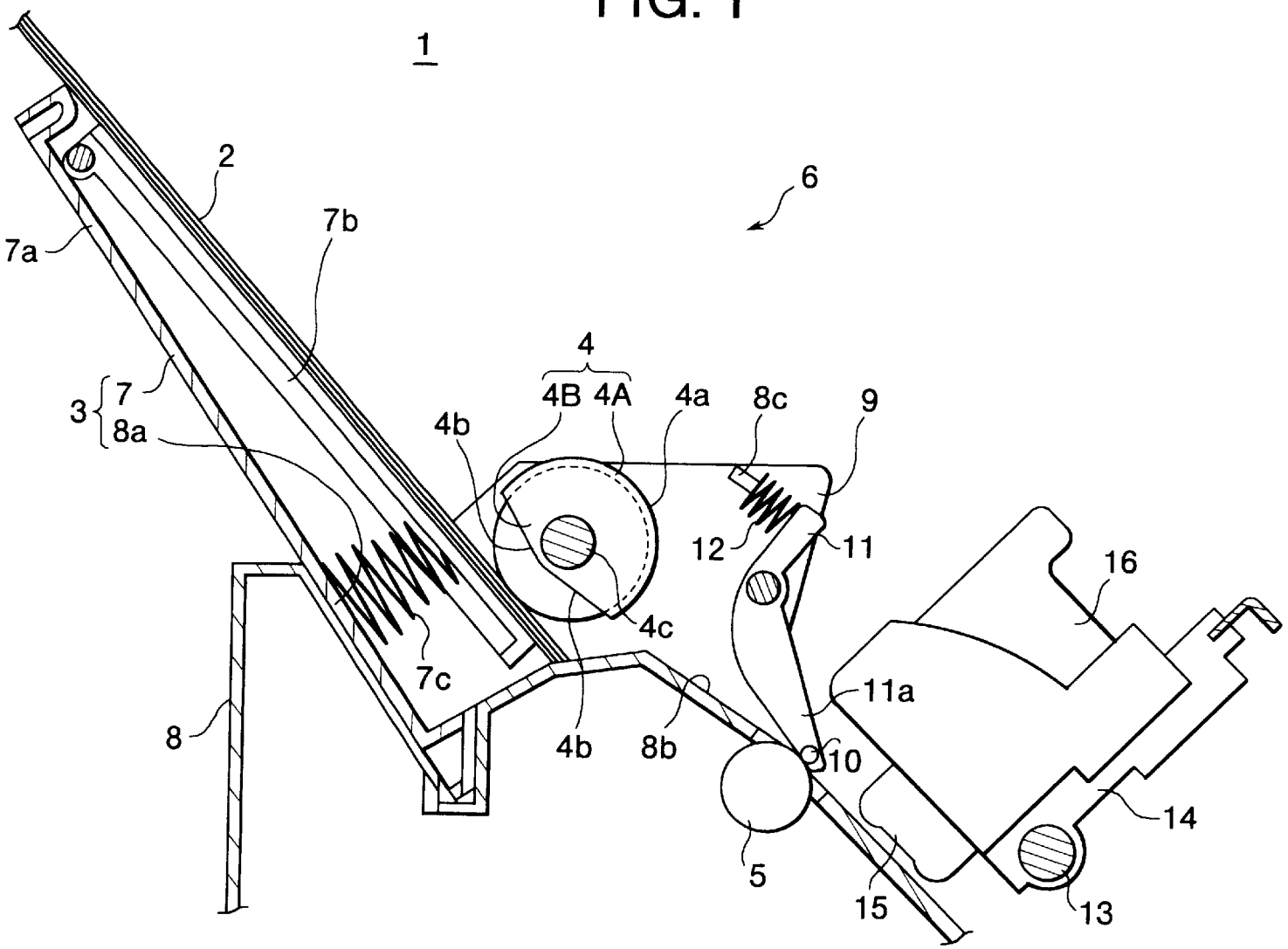
FIG. 1 is a side view in partial cross section showing a sheet-supply mechanism including a sheet-feed device according to a first embodiment of the present invention.

A sheet-supply device according to preferred embodiments of the present invention will be described while referring to the accompanying drawings wherein like parts and components are designated by the same reference numerals to avoid duplicating description.

FIG. 1 schematically shows configuration of an ink Jet printer 1. The ink jet printer 1 includes a sheet-supply device 6 for feeding a plurality of print sheets 2 stacked in a hopper 3 one at a time to a transport roller 5 disposed at a position downstream, in a sheet-supplying direction, from a sheet-feed roller 4.

The hopper 3 includes an engagement recess portion 8*a* of a printer frame 8 and a sheet-supply cassette 7 detachably attached to the engagement recess portion 8*a*. The sheet-supply cassette 7 includes a casing 7*a*, a pressing upper plate 7*b* rotatably supported at its upper edge to the casing 7*a*, and a spring 7*c* disposed between the pressing upper plate 7*b* and the casing 7*a*. The spring 7*c* urges the pressing upper plate 7*b* to press upward against the print sheets 2 stacked on the pressing upper plate 7*b*.

The sheet-feed roller 4 is supported between right and left sides portions 9, 9 of the printer frame 8 via a rotation shaft 4*c*. The sheet-feed roller 4 includes a sheet-feed roller portion 4A and a non-sheet-feed portion 4B. The sheet-feed roller portion 4A is substantially semicircular in cross section and has an arc surface 4*a* for contacting the print sheets 2. The non-sheet-feed portion 4B is substantially triangular shaped in cross section and has a pair of surfaces 4*b*, 4*b* incapable of contacting the print sheets 2. The sheet-feed roller portion 4A is configured to contact the upper surface of print sheets 2 and feed the print sheets 2 one by one toward the transport roller 5. The arc surface 4*a* has a long enough surface to transport print sheets 2 from the hopper 3 to the transport roller 5 by rotation of the sheet-feed roller 4.

A collar member 17 is freely rotatably provided on the same shaft as the sheet-feed roller 4 and assists the transport roller 5 in transporting print sheets 2. The collar member 17 also maintains a space between the print sheets 2 and the non sheet-feed portion 4B, thereby insuring that the print sheets 2 and the non-sheet-feed portion 4B will not contact.

The transport roller 5 is rotatably supported below the sheet-feed roller 4 so that a portion of its outer periphery protrudes above a sheet-guide surface 8*b* on which print sheets 2 from the sheet-feed roller 4 will slide. A print head 15 is disposed below the transport roller 5. A discharge roller (not shown in the drawings) is rotatably supported below the transport roller 5 and discharges print sheets 2 printed on by a print head 15.

A support member 11 including a plurality of V-shaped arm portions 11*a* is disposed adjacent to the sheet-guide surface 8*b*. A slave roller 10 is rotatably supported in confrontation with the transport roller 5 on the tip of each arm portion 11*a* of the support member 11. A spring 12 is disposed between the upper edge portion of each arm portion 11*a* and a corresponding spring receiving portion 8*c* of the printer frame 8. The springs 12 constantly urge the support member 11 to rotate in a clockwise direction, that is, as viewed in FIG. 1. As a result, the slave rollers 10 are pressed against the transport roller 5.

The print head 15 is mounted on a carriage 14 slidably mounted on a guide rail 13, which is below the transport roller 5 with respect to a sheet-supplying direction. The carriage 14 is provided reciprocally movable along the guide rail 13. A plurality of ink cartridges 16 storing ink to be supplied to the ink head 15 are detachably mounted on the carriage 14. It should be noted that the carriage 14 is driven by a drive means, for example, a carriage motor (not shown in the drawings) via a timing belt.

As best seen in FIGS. 2(*a*) through 2(*c*), an attachment plate 17 is fixed to one of the side portions 9 by a screw 18. A transport motor 19 is fixed on the inner surface of the attachment plate 17. The transport motor 19 serves as a rotational type drive source capable of generating drive force by rotating in both forward and reverse directions and, as will be described later, can be selectively driven in either a forward rotational direction, in which print sheets 2 are transported in a sheet-transporting direction, or a reverse rotational direction, in which print sheets 2 are transported against the sheet-transporting direction.

A drive force transmission mechanism 22 is provided on the outer surface of the attachment plate 17. The drive force transmission mechanism 22 is for constantly rotating the sheet-feed roller 4 forward to supply print sheets 2 in a predetermined sheet-supply direction and for selectively transmitting and interrupting transmission of rotational drive force from the transport motor 19 to the sheet-feed roller 4.

The drive force transmission mechanism 22 is formed from a plurality of gears. Specifically, a drive gear 23 is connected to the drive shaft of the transport motor 19. The drive gear 23 is meshingly engaged with a large diameter idle gear 25 integrally provided to the same shaft as a small diameter idle gear 24. The small diameter idle gear 24 is meshingly engaged with a transport roller gear 26 serving as a transport gear. The transport roller gear 26 is integrally provided to the transport roller 5. With this configuration, the transport roller 5 is constantly driven to rotate by the transport motor 19.

The transport roller gear 26 is also meshingly engaged with a large diameter middle gear 27. The middle gear 27 is rotatably disposed on a rotational shaft 27*a*. A first and a second plate members 28A, 28B are provided independently rotatable around the middle gear 27. A first and a second planetary gears 29, 30 are rotatably supported on shaft portions 29*a*, 30*a*, respectively at the tips of the first and the second plate-members 28A, 28B, respectively. The first and the second planetary gears 29, 30 ate meshingly engaged with the middle gear 27, which serves as a sun gear, and can also revolve around the rotational shaft 27*a*. A first and a second guide apertures 17*a*, 17*b* are formed in the attachment plate 17. The shaft portions 29*a*, 30*a* of the first and the second planetary gears 29, 20 are slidably engaged in the first and the second guide apertures 17*a*, 17*b*, respectively, which serve as a control means for controlling pivotal range of the first and the second planetary gears 29, 30.

A sheet-feed roller gear 31 is connected to the roller shaft 4*c* of the sheet-feed roller 4 so as to rotate in association with the sheet-feed roller 4. A supplemental gear 32 is disposed between the sheet-feed roller gear 31 and the second planetary gear 30. The supplemental gear 32 is rotatably supported on the side plate portion 9 and constantly in meshing engagement with the sheet-feed roller gear 31.

The first and the second planetary gears 29, 30 rotate around the middle gear 27 selectively into and out of driving connection with the sheet-feed roller gear 31, depending on rotational direction of the middle gear 27. That is to say, when the drive gear 23 drives the transport roller gear 26 to rotate in the same direction as the sheet-transport direction, the first planetary gear 29 is brought into meshing engagement with the sheet-feed roller gear 31. In this case the first planetary gear 29 is drivingly connected with the sheet-feed roller gear 31 by being directly engaged with the sheet-feed roller gear 31. On the other hand, when the drive gear 23 drives the transport roller gear 26 to rotate in a direction opposite to the sheet-transport direction, the second planetary gear 30 is brought into meshing engagement with the supplemental gear 32, and consequently into driving connection with the sheet-feed roller gear 31. With this configuration, the sheet-feed roller is rotated in a sheet-supply direction, regardless of which of the first and second planetary gears 29, 30 are engaged with the sheet-feed roller gear 31.

The sheet-feed roller gear 31 includes a first and second gear portions 31A, 31B for independently engaging with the first and second planetary gears 29, 30, respectively. The first planetary gear 29 becomes meshingly engaged with the first gear portion 31A when the drive gear 23 rotates in the forward rotational direction. The first gear portion 31A includes a toothless portion 31*a* formed by cutting off a portion of the teeth at the periphery of the first gear portion 31A. The toothless portion 31*a* and the non-sheet-feed portion 4B face substantially in opposite directions so that when the non-sheet-feed portion 4B confronts the uppermost print sheet 2 in the sheet-supply cassette 7, the toothless portion 31*a* confronts the first planetary gear 29. Also, when the sheet-feed roller 4 completes one full rotation from this initial condition, the toothless portion 31*a* and the first planetary gear 29 will again be in confrontation. Therefore, rotation of the sheet-feed roller 4 is stopped after each complete rotation so that the sheet-feed roller 4 is returned to its initial condition.

It should be noted that the toothless portion 31*a* of the first gear portion 31A is formed longer than the peripheral length of the non sheet-feed portion 4*b* of the sheet-feed roller 4 so that the first planetary gear 29 can be easily brought into opposition with the toothless portion 31*a*. A spring 33 serving as an urging means is provided between the first plate member 28A and a spring receiving portion 17*c* of the attachment plate 17. The spring 33 constantly urges the first planetary gear 29 toward engagement with the first gear portion 31A of the sheet-feed roller gear 31 so that the first planetary gear 29 can be smoothly engaged with the first gear portion 31A when the drive gear 23 rotates in a forward direction.

The first guide aperture 17*a* is formed in the attachment plate 17 so that when the shaft portion 29*a* is at one edge thereof, the first planetary gear 29 can engage with the first gear portion 31A but can not contact the surface of the toothless portion 31*a* and so that when the shaft portion 29*a* is at the other edge thereof, the first planetary gear 29 is slightly separated from the first gear portion 31A.

The second guide aperture 17*b* is formed to follow about 45 degrees of an imaginary circle centered on the middle gear 27. The second guide aperture 17*b* is formed so that when the shaft portion 30*a* is at one edge thereof, the second planetary gear 30 can meshingly engage with the supplemental gear 32 and when the shaft portion 30*a* is at the other edge thereof, the second planetary gear 30 can not engage with the supplemental gear 32 while the transport roller gear 26 rotates a predetermined amount in the reverse rotational direction.

Therefore, the pivoting range for bringing the first planetary gear 29 into meshing engagement with the sheet-feed roller gear 31 by rotating the transport motor 19 in the forward rotational direction is set smaller than the pivoting range for bringing the second planetary gear 30 into meshing engagement with the supplemental gear 32 (i.e., into driving connection with the sheet-feed roller gear 31) by rotating the transport motor 19 in the reverse rotational direction. As a result, transmission of rotational force from the transport motor 19 to the sheet-feed roller 4 is interrupted for a shorter time when rotational direction of the transport motor 19 is switched from reverse to forward than when switched from forward to reverse.

Figure 3:
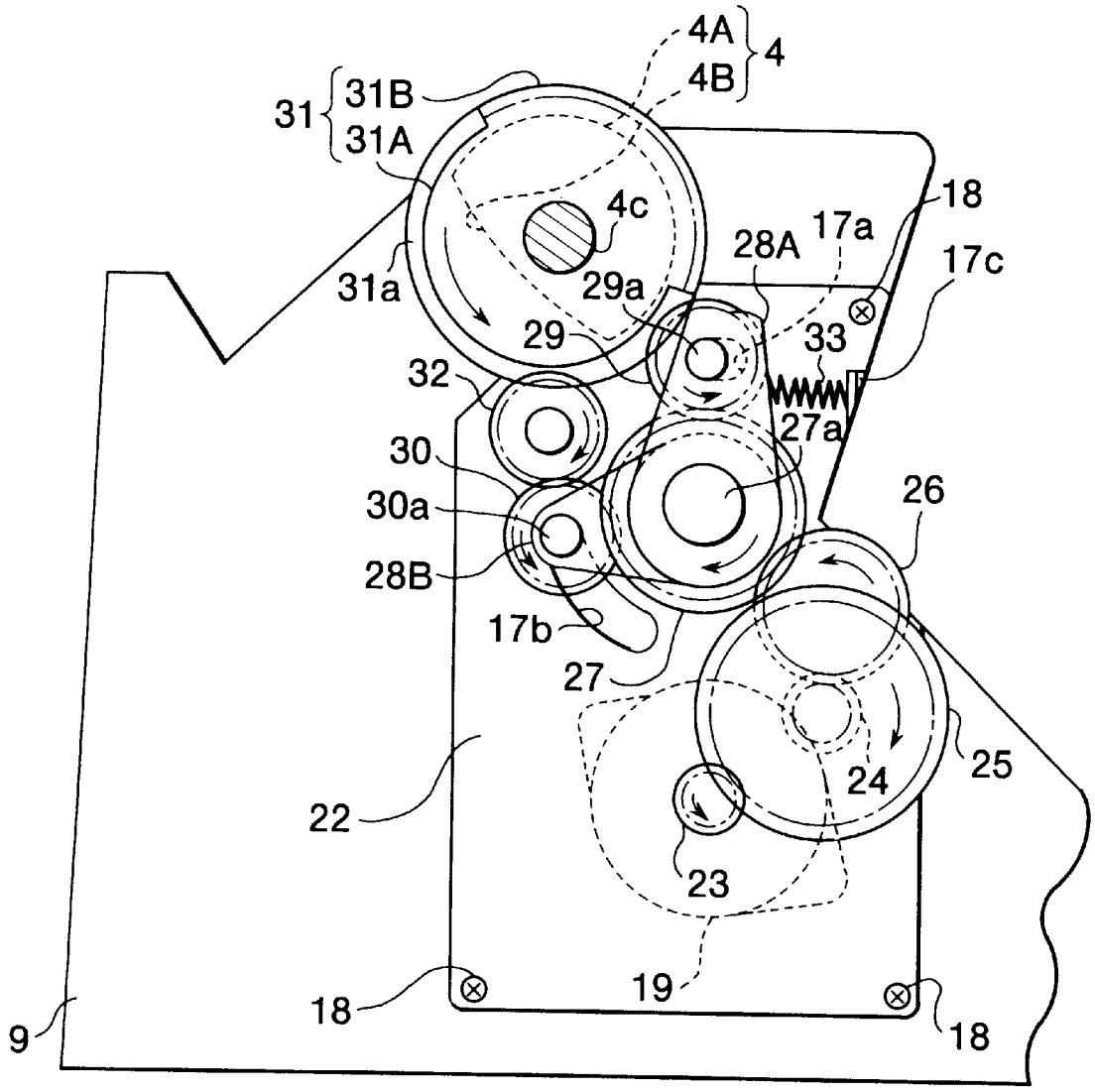
FIG. 3 is a side view showing the sheet-feed device of FIG. 2(*a*) after a drive motor starts rotating in a reverse direction.

The transport motor 19, which serves as a drive source, is controlled by a control means (not shown in the drawings) to feed print sheets 2 for printing. An illusory example will be provided while referring to FIGS. 3 to 6. As shown in FIG. 3, when the transport motor 19 is rotated in the reverse rotational direction, the transport roller gear 26 is driven to rotate via the large diameter idle gear 25 and the small diameter idle gear 24 so that the transport roller 5 is rotated in a direction opposite that required to transport print sheets 2 to the print head 15. Further, the transport roller gear 26 rotates the middle gear 27 so that the second plate member 28B is pivoted clockwise and the second planetary gear 30 comes into meshing engagement with the supplemental gear 32. As a result, the sheet-feed roller gear 31, which is meshingly engaged with the supplemental gear 32, and the sheet-feed roller 4, which is connected to the sheet-feed roller gear 31, are rotated in the forward rotational direction so that a print sheet 2 is fed toward the transport roller 5. Here the distance that the second planetary gear 30 can pivot is regulated by engagement between the second guide aperture 17*b* of the attachment plate 17 and the shaft portion 30*a* of the second planetary gear 30.

Figure 4:
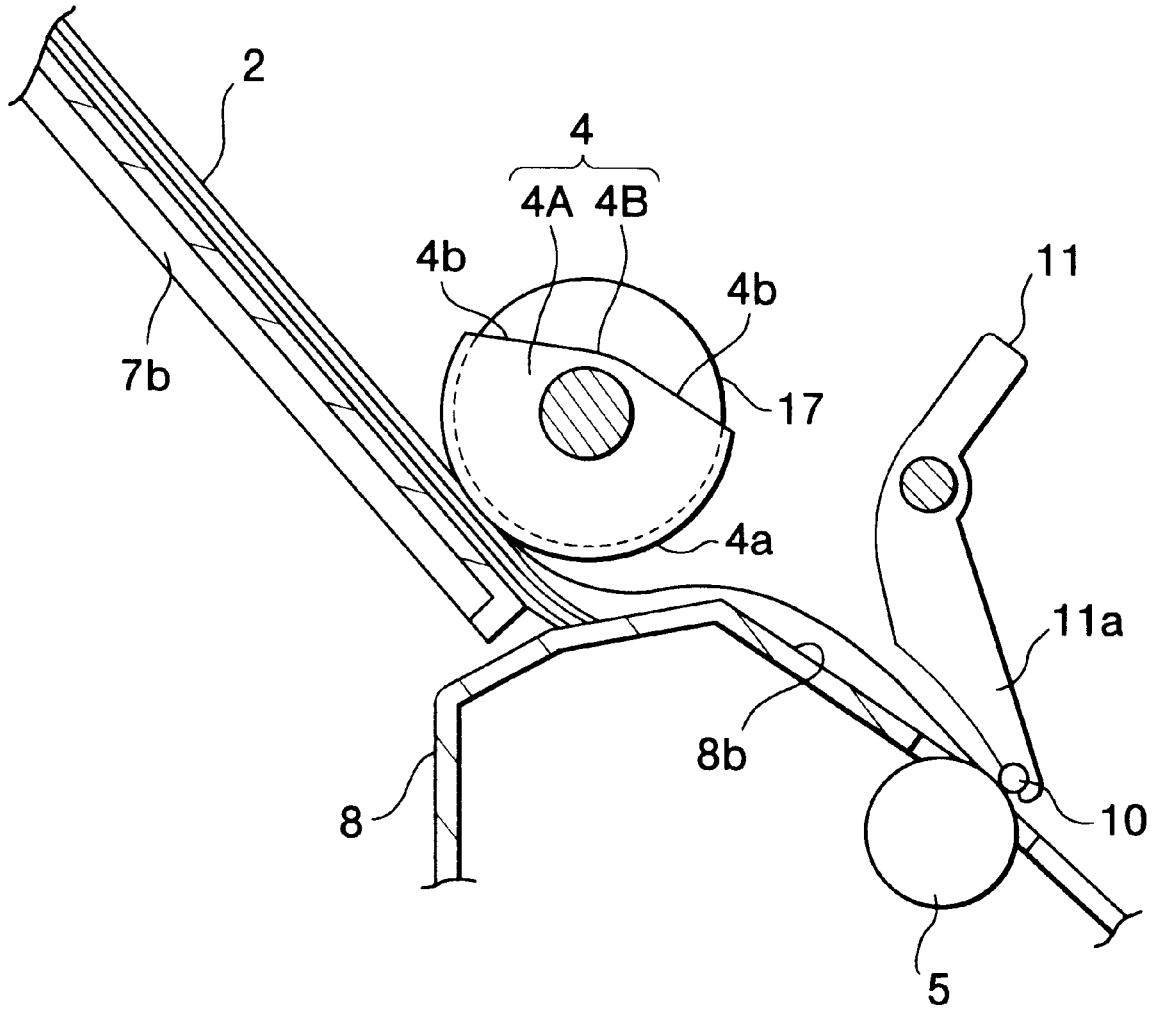
FIG. 4 is a side view showing condition of the sheet-supply device of FIG. 1 after the drive motor rotates in the reverse direction.
Figure 5:
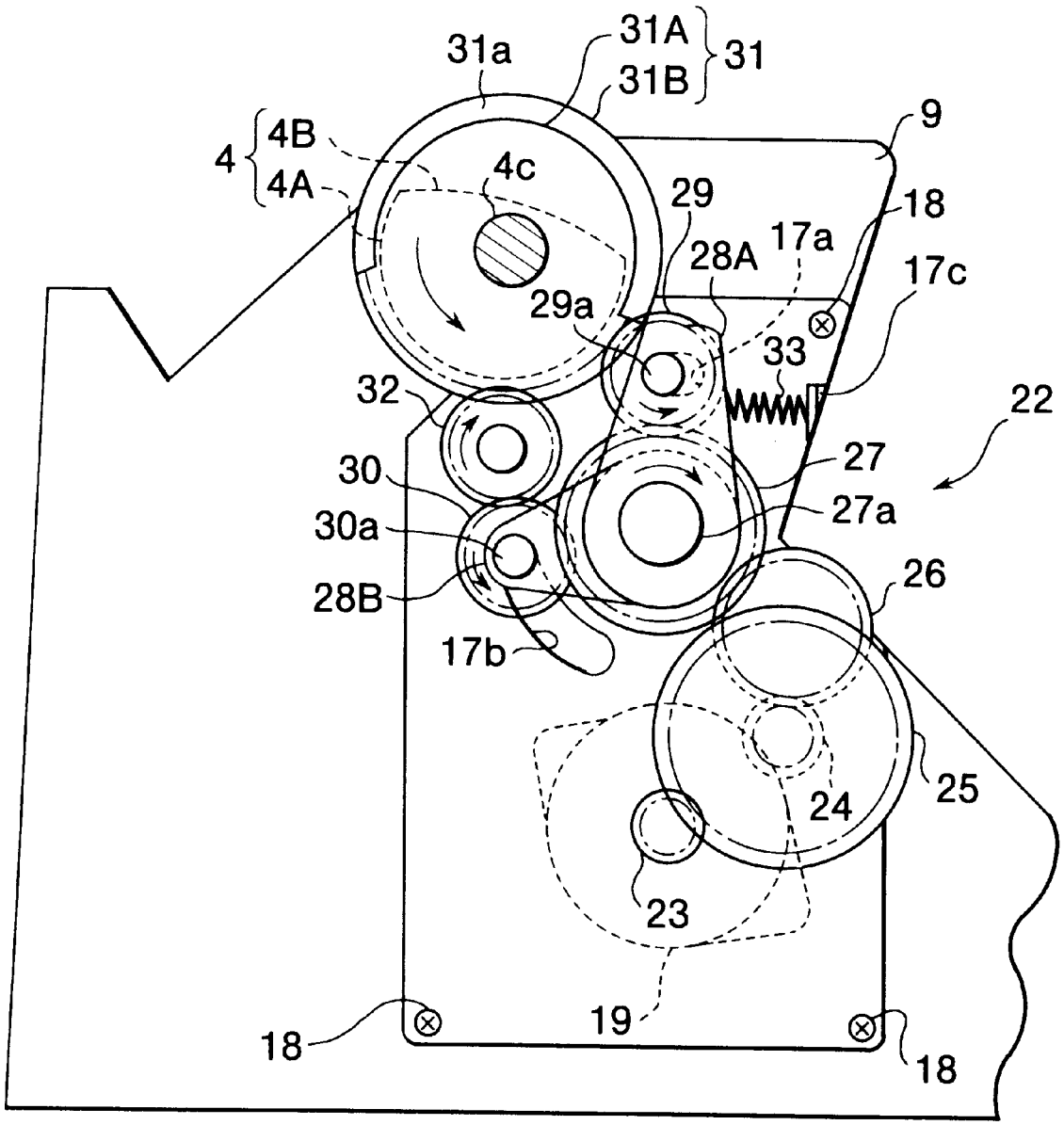
FIG. 5 is a side view showing the sheet-feed device of FIG. 2(*a*) when the sheet-supply device is in the condition shown in FIG. 4.

As shown in FIG. 4, rotation of the sheet-feed roller 4 to a certain degree will bring a print sheet 2 to the transport roller 5 and then further press the print sheet 2 against the transport roller 5 so that it bends upward between the rollers 4, 5. This positions the front edge of the print sheet 2 at the contact point between the transport roller 5 and the slave roller 10 and also prevents the print sheet 2 from slanting. As shown in FIG. 5, at this time the second planetary gear 30 is drivingly connected with the second gear portion 31B via the supplemental gear 32. Although the spring 33 urges the first planetary gear 29 into engagement with the rotating first gear portion 31A, the rotational direction of the first planetary gear 29 is the same as that of the sheet-feed roller gear 31, and so opposite that for engaging with the first gear portion 31A. Therefore, the first planetary gear 29 will be repelled from the first gear portion 31A against the urging force of the spring 33.

Figure 6:
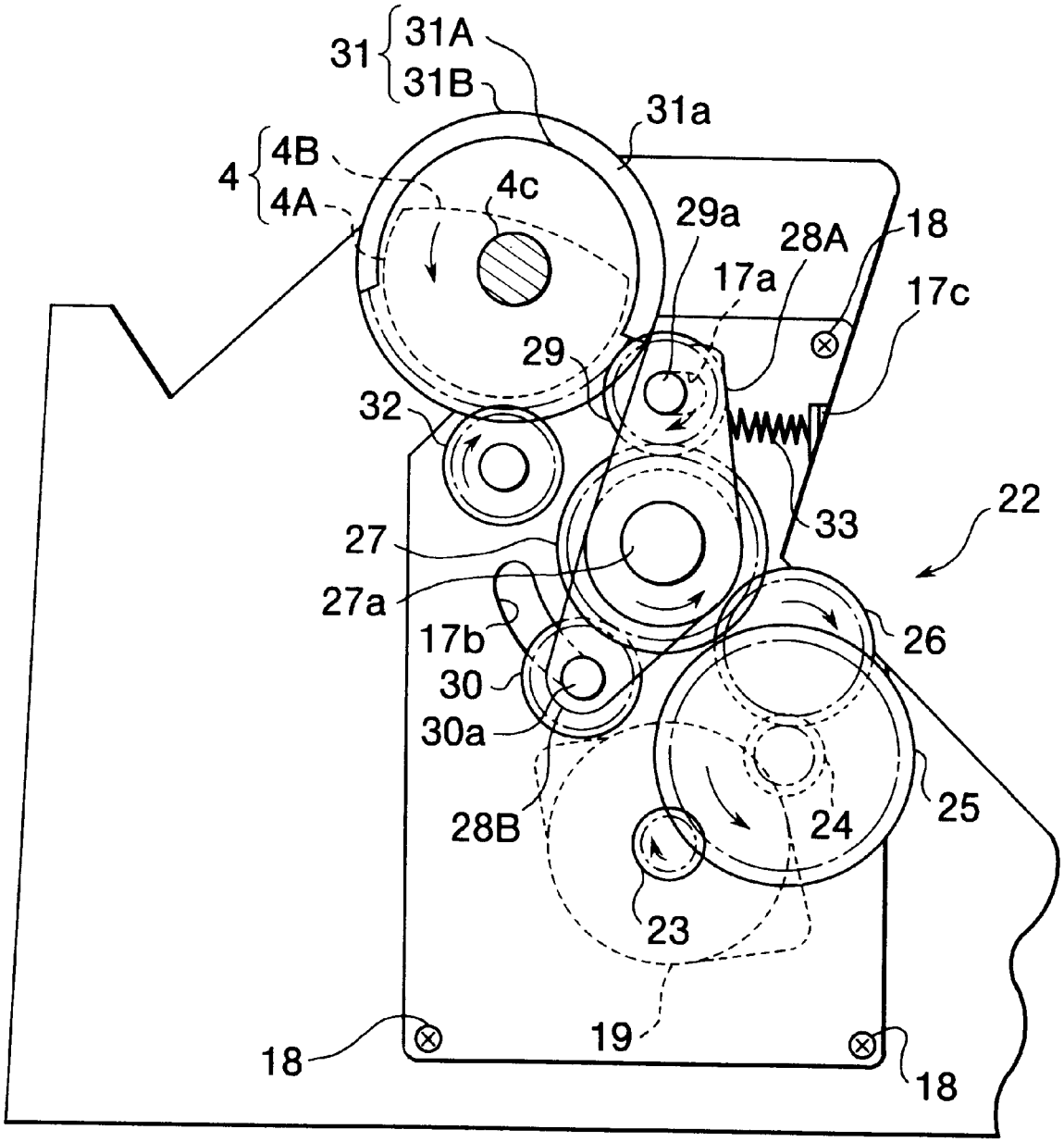
FIG. 6 is a side view showing the sheet-feed device of FIG. 2(*a*) after rotational direction of the drive motor switches to forward rotation.

Next, as shown in FIG. 6, the transport motor 19 is driven to rotate in the forward direction so that the transport roller 5 starts to rotate in its forward rotational direction for transporting the print sheet 2. Also, the second plate member 28B pivots counterclockwise so that engagement between the second planetary gear 30 and the supplemental gear 32 is released. Further, the first plate member 28A pivots counterclockwise so that the first planetary gear 29 is guided by the first guide aperture 17*a* into direct engagement with the gear portion 31A of the sheet-feed roller gear 31. With this engagement, the sheet-feed roller gear 31, and consequently the sheet-feed roller 4, is rotated further and the print sheet 2 is transported toward the print head 15 by the transport roller 5.

When the sheet-feed roller 4 completes one full rotation, then, as shown in FIG. 2, the first planetary gear 29 will oppose the toothless portion 31A of the first gear portion 31A so that transmission of drive force to the sheet-feed roller 4 is interrupted. Also, the non-sheet-feed portion 4B of the sheet-feed roller 4 stops in opposition with the print sheet 2.

As described above, the second planetary gear 30 moves to the edge of the guide aperture 17*b* until it separates from the supplemental gear 32 and the sheet-feed roller 4 stops.

With this configuration, the transport roller 5 continues to transport the print sheet 2 at a set speed by rotation of the transport motor 19 even after rotation of sheet-feed roller 4 stops. When enlarged characters are being printed by first printing the lower half and then the upper half, the transport roller 5 is used to transport the print sheet 2 back by a required distance, for example, 8 mm, to print the upper half of the enlarged characters after printing the lower half of the characters. Although rotation of the transport roller gear 26 will also rotate the second planetary gear 30 and the middle gear 27 by an angle corresponding to the 8 mm, the second planetary gear 30 will not pivot enough to meshingly engage it with the supplemental gear 32. Therefore, the print sheet 2 can be transported back by a distance corresponding to the distance the second planetary gear 30 shifts to the edge of the second guide aperture 17*b* while the sheet-feed roller 4 remains stopped because transmission of drive force to the sheet-feed roller 4 is interrupted.

The spring 33 can be omitted from the above-described configuration. That is to say, even without the spring 33, the first planetary gear 29 can engage the sheet-feed roller gear 31 in accordance with forward rotation of the middle gear 27 and separate from the sheet-feed roller gear 31 in accordance with reverse rotation of the middle gear 27. As long as the guide aperture 17*a* is formed to restrict the pivoting range of the first planetary gear 29 to smaller than that of the second planetary gear 30, the same effects achieved by the above-described configuration can be achieved.

As described above, transmission of drive force by the drive force transmission mechanism 22 from the transport motor 19 to the sheet-feed roller 4 is interrupted when rotational direction of transport motor 19 is switched between the reverse rotational direction and the forward rotational direction. This results in a period when the sheet-feed roller 4 can not be rotated. The present invention sets the non-rotatable period shorter when the rotational direction of the transport motor 19 is switched from reverse to forward rotation than from forward to reverse rotation. As a result, the drive force transmission mechanism 22 can be switched more quickly during sheet-feed. Because the non-rotatable period during sheet-feed is shorter and switching can be performed more quickly, less time will be lost so that the total time for a sheet feed will be shortened. Also, the print sheets 2 bent between the sheet-feed roller 4 and the transport roller 5 will only rarely flatten out so that the front edge of the print sheet 2 can be positioned and aligned more reliably. On the other hand, because transmission of drive force is interrupted for a longer time when the rotational direction is switched from the forward rotational direction to the reverse rotational direction, transmission of drive force to the sheet-feed roller 4 will be interrupted for a sufficiently long to enable transporting the print sheet 2 a predetermined amount in the reverse direction while the sheet-feed roller 4 is stopped.

The pivoting range of the first planetary gear 29, which is drivingly connected to the sheet-feed roller gear 31 when the transport motor 19 rotates in the forward rotational direction, is set smaller than that of the second planetary gear 30, which is drivingly connected to the sheet-feed roller gear 31 when the transport motor 19 rotates in the reverse rotational direction. Therefore, with a simple configuration, interruption in transmission of drive force can be set shorter for when the rotational direction of the transport motor 19 switches from reverse to forward rotation than for when the transport motor 19 switches from forward to reverse rotation.

Further, because the transport motor 19 is drivingly connected to the sheet-feed roller 4 via the drive force transmission mechanism 22, the sheet-feed roller 4 will be rotated in the forward rotational direction regardless of which direction the transport motor 19 is rotated. With this configuration, the print sheet 4 will not be damaged. Because the spring 33 constantly urges the first planetary gear 29 in the direction for engaging with the sheet-feed roller gear 31, the first planetary gear 29 can be smoothly engaged with the sheet-feed roller gear 31 when the transport motor 19 is driven to rotate in the forward rotational direction.

When the engagement condition of the sheet-feed roller gear 31 switches from engagement with the second planetary gear 30 to engagement with the first planetary gear 29, the first planetary gear 29 will attempt to engage with the rotating first gear portion 31A. However, with the above-described configuration, the first planetary gear 29 will be rotating in the direction opposite that required for engagement between the first planetary gear 29 and the sheet-feed roller gear 31. Therefore, the first planetary gear 29 will separate from the sheet-feed roller gear 31 against the urging force of the spring 33.

Figure 7:
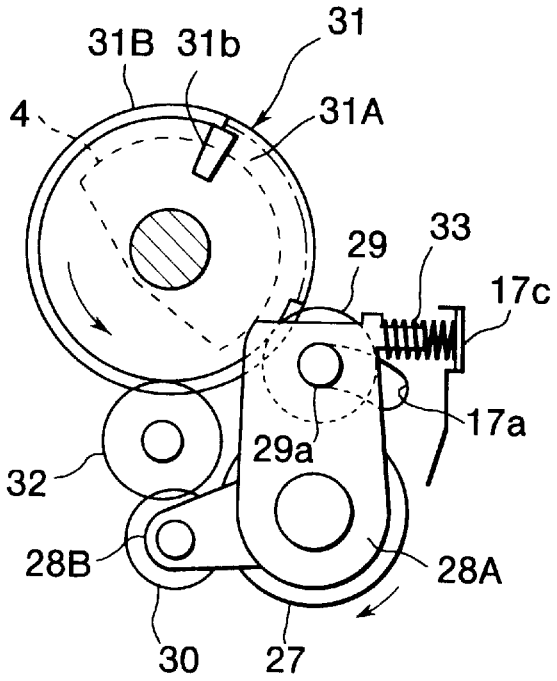
FIG. 7 is a side view showing a modification of the sheet-feed device of the first embodiment in a condition similar to that shown in FIG. 3.
Figure 8:
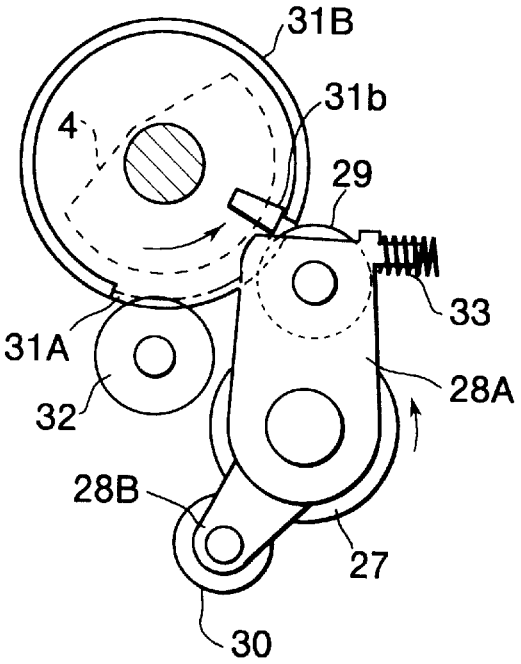
FIG. 8 is a side view showing the modification of FIG. 7 in a condition similar to that shown in FIG. 5.
Figure 9:
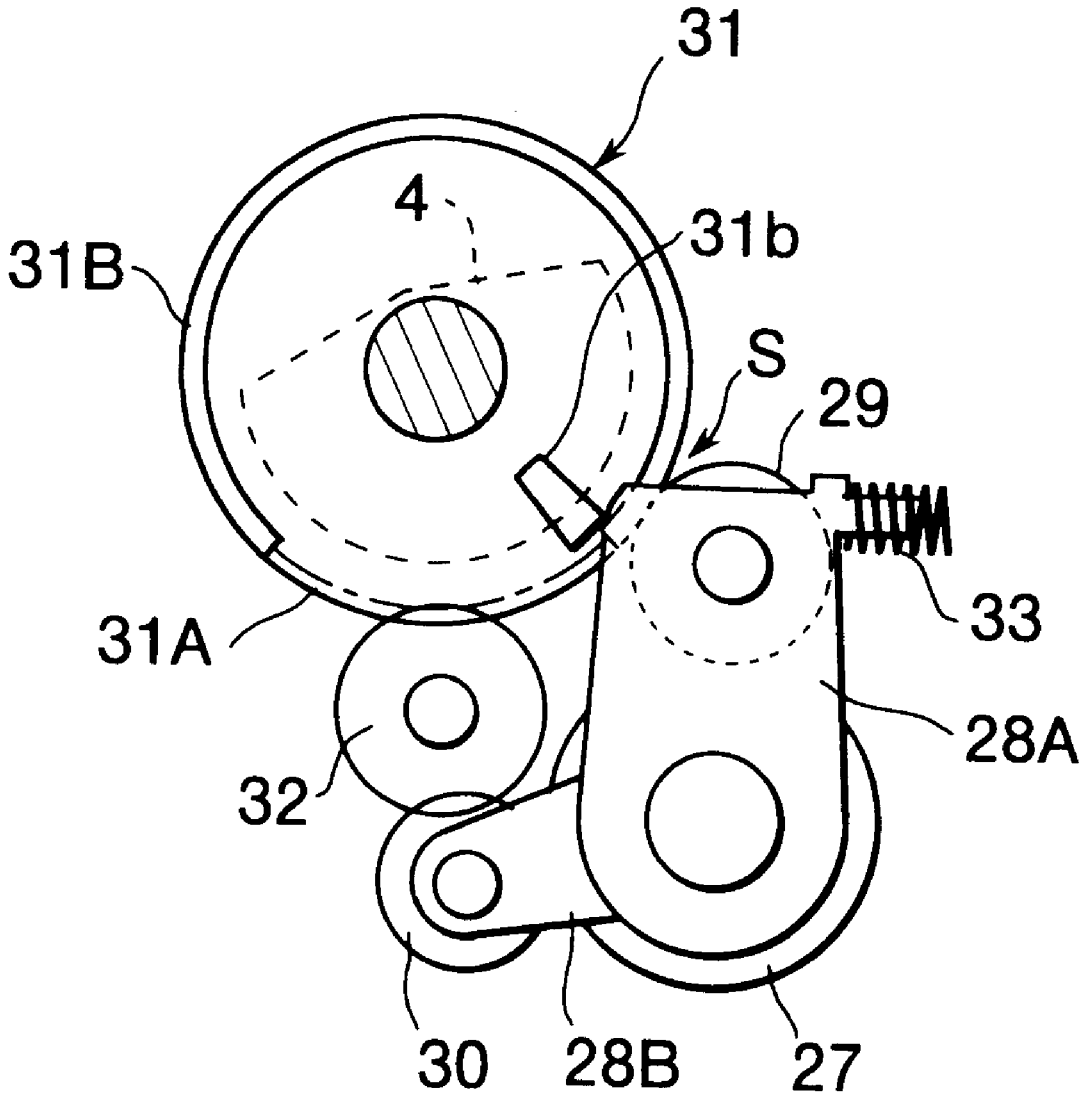
FIG. 9 a side view showing the modification of FIG. 7 in a condition similar to that shown in FIG. 6.

However, at this time, the collision between the teeth of the first planetary gear 29 and the second planetary gear 30 will create noise. However, to prevent such noise, as shown in FIGS. 7 to 9, a protrusion 31*b* can be provided to the side surface of the sheet-feed roller gear 31 at the border between the toothless portion 31*a* and toothed portion of the first gear portion 31*a*. The protrusion portion 31*b* serves as a cam for separating the first planetary gear 29 from the sheet-feed roller gear 31 against the urging force of the spring 33 when the first planetary gear 29 is rotating in the direction opposite that required for it to engage with the first gear portion 31A, that is, while the second planetary gear 30 is still drivingly connected with the sheet-feed roller gear 31 when the driving connection of the sheet-feed roller gear 31 switches from with the second planetary gear 30 to the first planetary gear 29.

With this configuration, when the engagement condition is switched from the second planetary gear 30 being engaged with the second gear portion 31B to the second planetary gear 30 being engaged with the first gear portion 31A, because the protrusion portion 31*b* is provided to the sheet-feed roller gear 31, as shown in FIG. 9 the first plate member 28A rotatably supporting the first planetary gear 29 around the sun gear 27 is pressed against the urging force of the spring 33 so that the first planetary gear 29 is separated from the sheet-feed roller gear 31 and a space S is opened between the first planetary gear 29 and the first gear portion 31A. Accordingly, the teeth of the first gear portion 31A and the first planetary gear 29 will not collide, and noise will not be created, when the engagement condition is changed.

Figure 10:
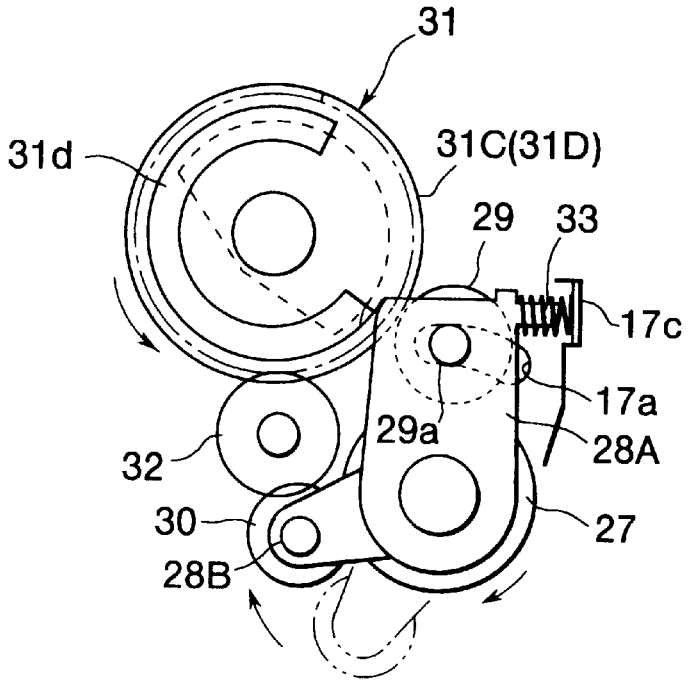
FIG. 10 is a side view showing another modification of the sheet-feed device of the first embodiment in a condition similar to that shown in FIG. 3.
Figure 11:
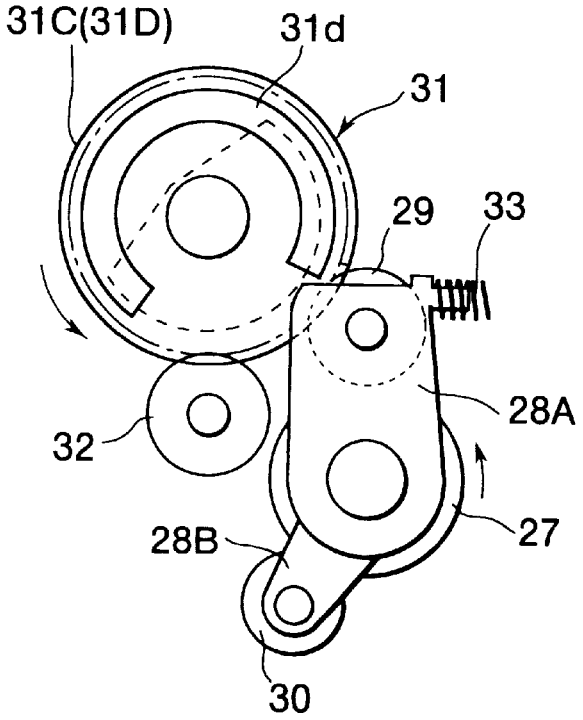
FIG. 11 is a side view showing the modification of FIG. 11 in a condition similar to that shown in FIG. 5.
Figure 12:
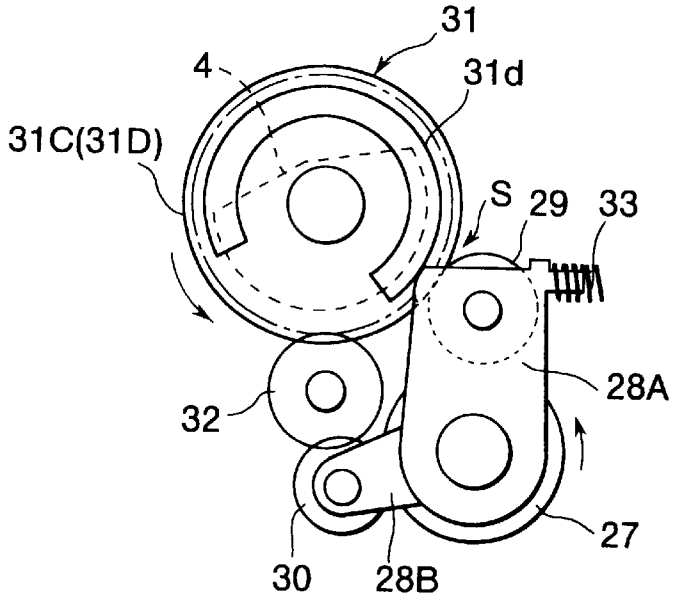
FIG. 12 is a side view showing the modification of FIG. 11 in a condition similar to that shows in FIG. 6.

Although, the protrusion portion 31*b* was described above as being provided to a position determined by the relationship between the first gear portion 31A and the toothless portion 31*a*, instead, as shown in FIGS. 10 through 12, the sheet-feed roller gear 31 can be provided with first and second gear portions 31C, 31D having teeth all around their circumference. In this case, a semi-annular protrusion portion 31*d* having a cut out portion can be provided to the first gear portion 31C of the sheet-feed roller gear 31 in a range corresponding to the toothless portion 31*a*. With this configuration, the first planetary gear 29 can be separated away from the first gear portion 31C by the protrusion portion 31*d* in accordance with the rotation of the sheet-feed roller gear 31.

With this configuration, when the second planetary gear 30 is drivingly connected with the sheet-feed roller gear 31, as shown in FIG. 12 the protrusion 31*d* functions as a cam to separate the first planetary gear 29 from the sheet-feed roller gear 31 by the space S in accordance with the rotation of the sheet-feed roller gear 31. That is to say, the plate member 28A presses against the protrusion portion 31*d* so that the first planetary gear 29 is separated from the first gear portion 31C. The gears of the first planetary gear 29 and the first gear portion 31C will not collide so noise can be reduced.

Figure 13:
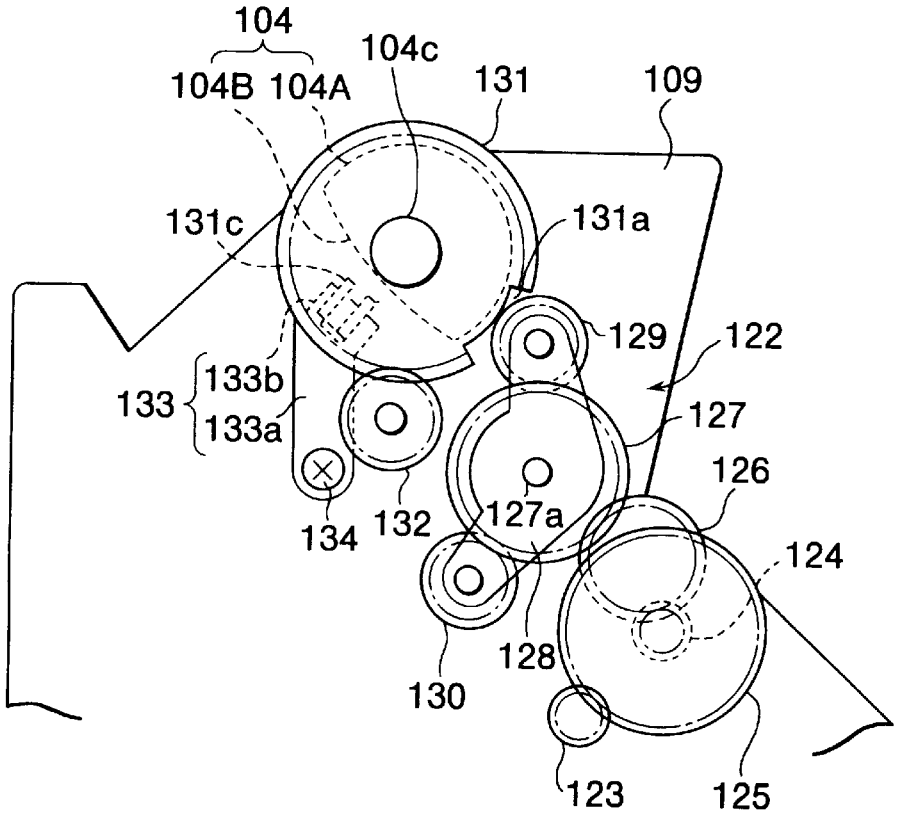
FIG. 13 is a side view showing a sheet-feed device according to a second embodiment of the present invention.

Next, a sheet-feed device according to a second embodiment will be described while referring to FIGS. 13 to 23(*b*). As shown in FIG. 13, a transport roller gear 126 is engaged with a large diameter middle gear 127. A first and second planetary gears 129, 130 are provided rotatable around the middle gear 127 as supported on an approximately C-shaped base plate 128. The first and second planetary gears 129, 130 are in constant engagement with the middle gear 127 and can freely rotate, or revolve, around the middle gear 127 on a rotational shaft 127*a*. A sheet-feed roller gear 131 is integrally connected with the roller shaft of the sheet-feed roller 104. Rotation of the middle gear 127 selectively, that is, depending on the rotational direction of the middle gear 127, brings the first and second planetary gears 129, 130 into driving connection with the sheet-feed roller gear 131, thereby rotating the sheet-feed roller 104 in the sheet-feed direction. Therefore, by driving the drive gear 123 to rotate in the direction for rotating the roller gear 126 in its sheet-transport direction, the first planetary gear 29 will engage directly with the sheet-feed roller gear 131. On the other hand, when the drive gear 123 is driven to rotate in the opposite direction, that is, the direction opposite that for rotating the transport roller gear 126 in the transport direction, then the second planetary gear 130 will be brought into engagement with a supplemental gear 132, which is rotatably supported on the side plate portion 109. This brings the second planetary gear 30 indirectly into driving connection with the sheet-feed roller gear 131. It should be noted that the supplemental gear 132 is normally engaged with the sheet-feed roller gear 131.

A toothless portion 131*a* is formed at a periphery of the sheet-feed roller gear 131. In the initial condition shown in FIG. 13, the first planetary gear 129 is in confrontation with the toothless portion 131*a*. After the sheet-feed roller 104 rotates one complete turn from the initial condition, the first planetary gear 129 will again be in confrontation with the toothless portion 31*a* so that rotation of the sheet-feed roller 104 also stops in the initial condition.

Figure 14:
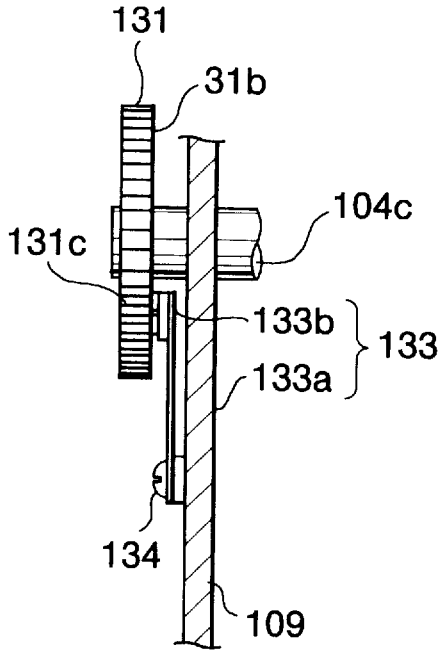
FIG. 14 is a side view showing vicinity of a sheet-feed roller gear in the sheet-feed device of FIG. 14.

As can best seen in FIG. 14, a plate-shaped spring member 133 serving as an urging means is disposed between the side plate portion 109 of the printer frame 108 and the side surface 131*b* of the sheet-feed roller gear 131. The spring member 133 includes an attachment base 133*a* for attaching the spring member 133 to the side plate portion 109 using a screw 134, and an engagement portion 133*b* connected to the tip of the attachment base 133*a*. The engagement spring portion 133*b* extends between the side plate 109 and the side surface 131*b* of the sheet-feed roller gear 131.

Figure 15:
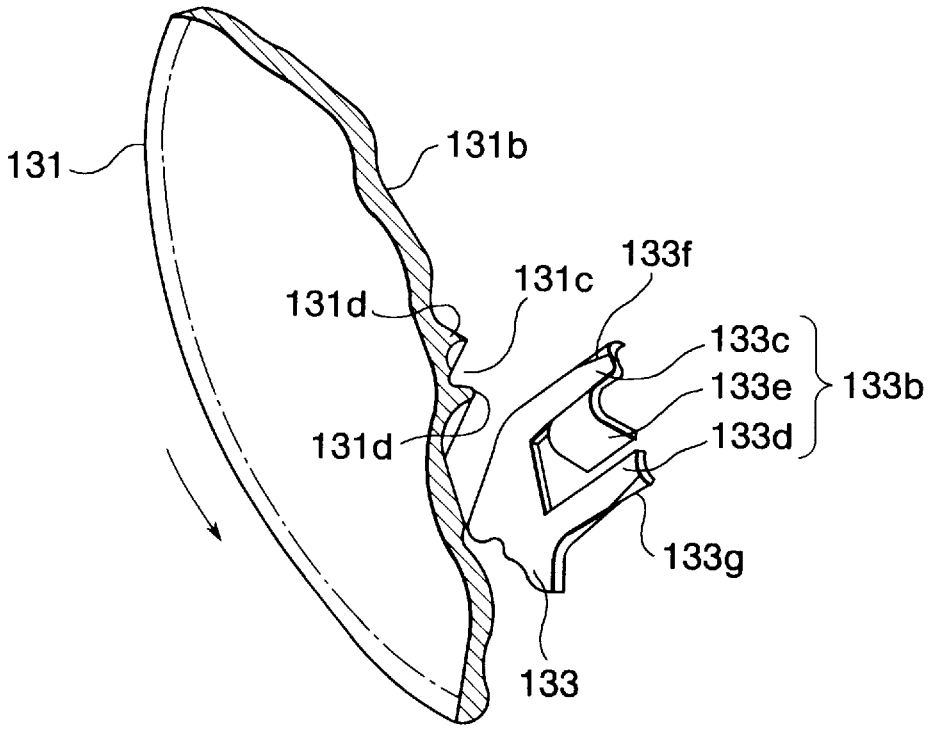
FIG. 15 is a schematic view showing relationship between the sheet-feed roller gear and a spring member in the sheet-feed device of FIG. 14.
Figure 16:
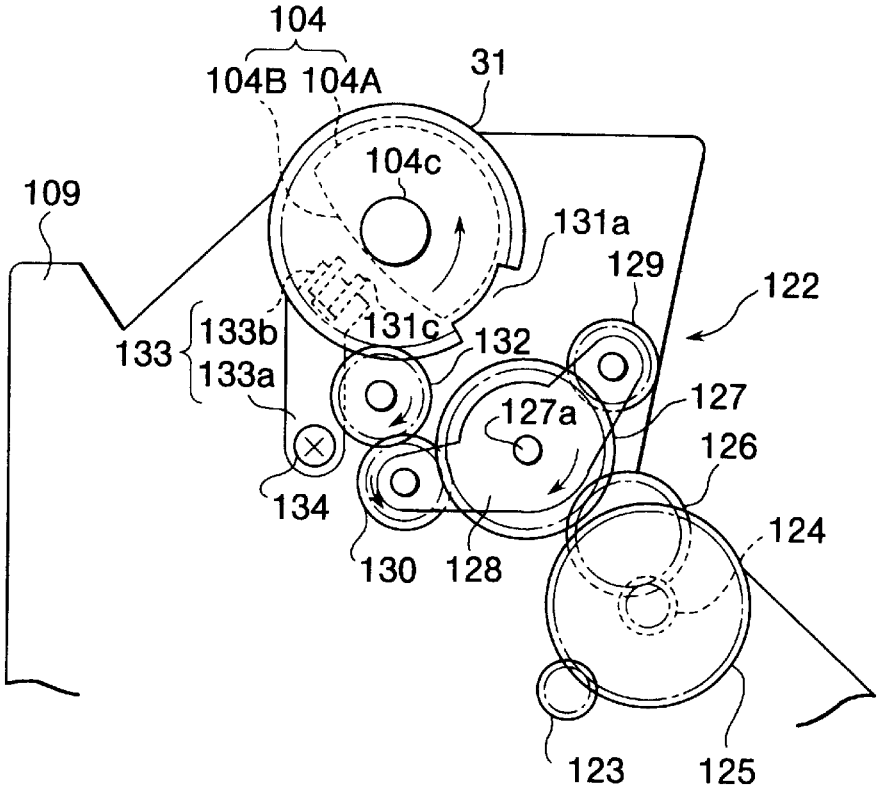
FIG. 16 is a side view showing the sheet-feed device of FIG. 14 after a drive motor starts rotating in a reverse direction.

As best can be seen in FIG. 15, the engagement spring member 133*b* includes a left and right pair of leg portions 133*c*, 133*d* and an engagement protrusion portion 133*e*. The leg portions 133*c*, 133*d* are provided at the tip of the spring member 133 and are separated by a fixed distance. The engagement protrusion portion 133*e* is connected to the leg portion 133*c* and is disposed in the space between the leg portions 133*c*, 133*d*. The engagement protrusion portion 133*e* is bent so as to protrude toward the side surface 131*b* of the sheet-feed roller gear 131.

Two protrusion portions 131*d*, 131*d* having roughly a triangular shape in cross section and separated by a fixed distance are formed on the side surface 131*b* of the sheet-feed roller gear 131. An engagement indentation portion 131*c* for detachably engaging with the engagement protrusion portion 133*e* is formed between the two protrusion portions 131*d*, 131*d*. When a torque equal to or greater than a set value is applied to and operates on the sheet-feed roller gear 131, then the engagement protrusion portion 133*e* rides over the protrusion portion 131*d* so that the engagement indentation portion 131*c* and the engagement spring portion 133*b* fall into engagement. Arc shaped guide surfaces 133*f*, 133*g* are formed in the outer edge portions of the leg portions 133*c*, 133*d*. The guide surfaces 133*f*, 133*g* are formed so that little resistant will result when the leg portions 133*c*, 133*d* abut against the protrusion portion 131*d*. The protrusion portions 131*d*, 131*d* do not normally abut against the leg portions 133*c*, 133*d*.

The engagement protrusion portion 133*e* of the engagement spring portion 133*a* engages detachably in the engagement indentation portion 131*c* during the stopped condition, that is, during the initial condition when the first planetary gear 129 confronts the toothless portion 131*a* and the non-sheet-feed portion 104B confronts the print sheet 102. The spring force of the spring member 133, therefore, resiliently maintains the sheet-feed roller in the stopped condition.

In this way, the spring member 133 serves as an urging means provided to the side surface 131*b* of the sheet-feed roller gear 131 and resiliently supports the sheet-feed roller 104 in its predetermined stopped condition.

Figure 17:
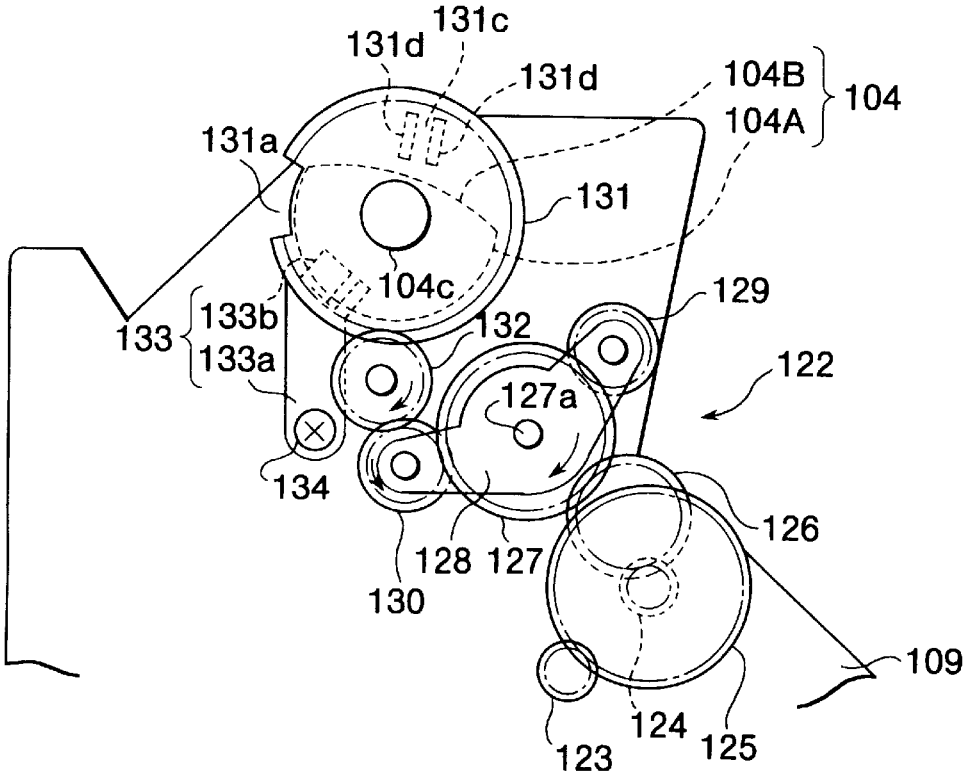
FIG. 17 is a side view showing the sheet-feed device of FIG. 14 after the drive motor rotates in the reverse direction.
Figure 18:
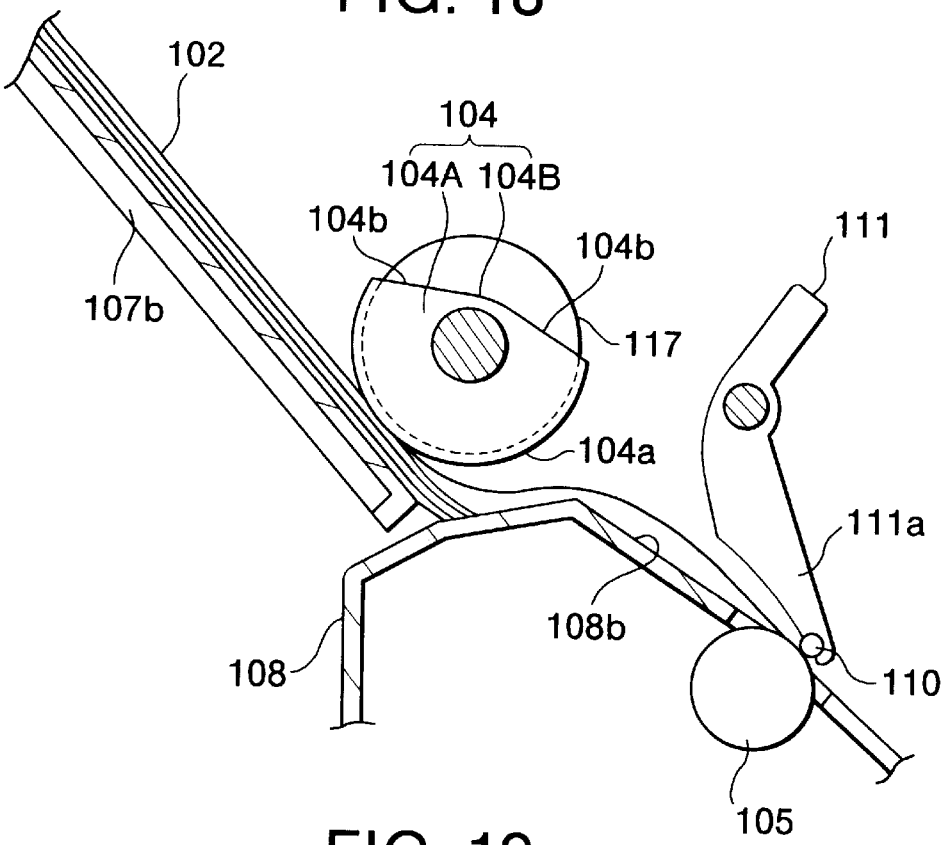
FIG. 18 is a side view showing condition of the sheet-supply device when the sheet-feed device is in the condition shown in FIG. 18.
Figure 19:
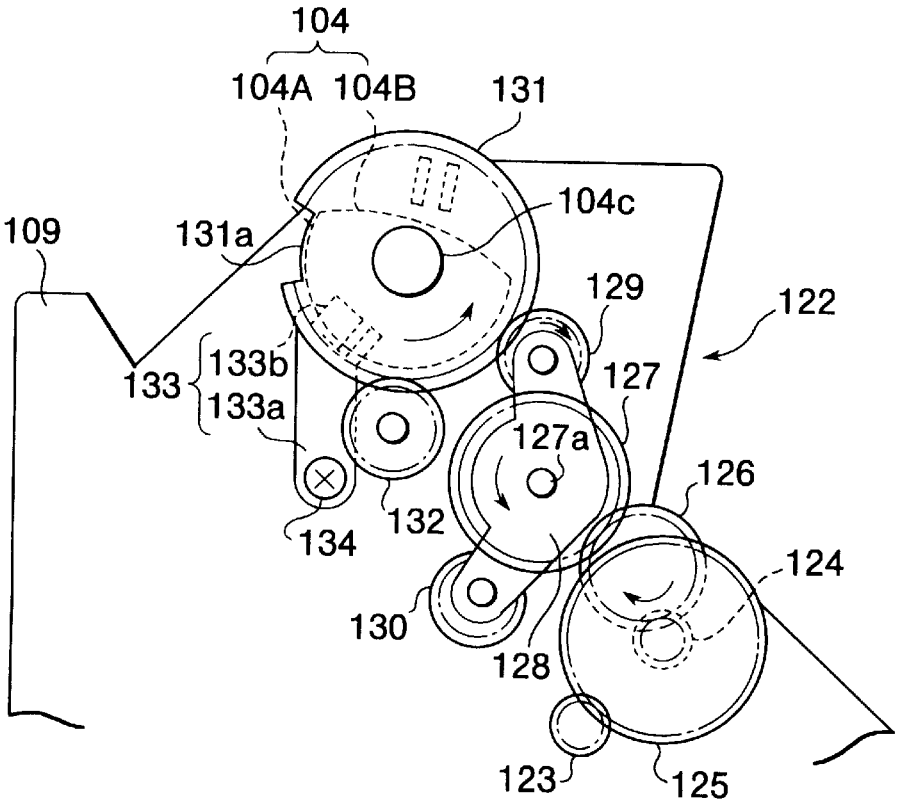
FIG. 19 is a side view showing the sheet-feed device of FIG. 14 after rotational directions of the drive motor switches to forward rotation.

In a manner similar to that described in the first embodiment, the middle gear rotates clockwise as viewed in FIG. 13 when the transport motor rotates in the reverse rotational direction. As shown in FIG. 17, the base plate 128 also rotates clockwise so that the second planetary gear 130 comes into engagement with the supplemental gear 132. Then, as shown in FIG. 17, because the sheet-feed roller 131 is in engagement with the supplemental gear 132, the sheet-feed roller 104 is rotated in its sheet-feed direction by the supplemental gear 132 so that it feeds the sheet 102 toward the transport roller 105. As shown in FIG. 18, the sheet 102 will be fed to the transport roller 105 by the sheet-feed roller 104 rotating by a predetermined angular amount, whereupon as shown in FIG. 19, the rotational direction of the transport roller 119 is switched to rotate in the forward rotational direction. Accordingly, the middle gear 127 and the base plate 128 will rotate in the counterclockwise direction so that the engagement between the second planetary gear 130 and the supplemental gear 132 is released and the first planetary gear 129 comes into direct engagement with the sheet-feed roller gear 131. Therefore, the first planetary gear 129 is drivingly connected with the sheet-feed roller gear 131. The sheet-feed roller gear 131 and consequently the sheet-feed roller 104 are further rotated until the sheet-feed roller 104 is rotated one complete turn and into its initial condition, where the sheet-feed roller 104 will be capable of supplying a subsequent sheet 102.

In this initial condition, the first planetary gear 129 is in confrontation with the toothless portion 131*a* so that engagement between the first planetary gear 129 and the sheet supply roller gear 131 is released. Moreover, the engagement protrusion portion 133*e* of the engagement spring portion 133*b* is detachably engaged in the engagement indentation portion 131*c* of the side surface 131*b*. Therefore, the sheet-feed roller 104 is resiliently maintained in its stopped condition after it rotates a predetermined amount. Accordingly, the sheet-feed roller gear 131, and consequently the sheet-feed roller 104, is rotated by drive force transmitted by the drive force transmission means 122 only when the second planetary gear 130 engages with the supplemental gear 132. Rotation of the sheet-feed roller 104 will therefore always start from the same initial condition.

Because the spring member 133 resiliently maintains the sheet-feed roller 104 in its initial condition shown in FIG. 13, even if the sheet 102 folds up or bends, it will not rotate the sheet-feed roller 104 in the counterclockwise direction by contacting it. Further, even though the center of gravity of the sheet-feed roller is above its rotational center in the stopped condition, it will not rotate in the clockwise direction by its self-weight. Therefore, even if the sheet roller 104 is vibrated by operation of the printer, the sheet-feed roller 104 will not rotate out of its stopped condition. Accordingly, sheet-feed operations by the sheet-feed roller 104 can always be performed at the same timing by drive force transmitted via the drive force transmission means 122. Because the sheet-feed roller 104 constantly starts rotating from the same initial condition, the feed amount of the sheet 102 will always be the same so that printing by the print head can always be started from a fixed position on the surface of the print sheet 112.

Because the plate-shaped spring member 133 is disposed between the side surface 131*b* of the sheet-feed roller 131 and the printer frame 108, therefore, dead space between the side surface 131*b* and the printer frame 108 can be used effectively and the printer can be produced in a more compact shape. Because the spring member 133 is formed in a plate shape, there is no need to provide an arm and an engagement pin which serve as a fixing means in conventional devices and which require space in the widthwise direction of the sheet-feed roller gear 131. Therefore, the amount of space required between the side plate portion 109 and the side surface 131*b* is smaller than in conventional devices so that bending of the roller shaft 104*c*, which is a cantilever supporting the sheet roller 104 at its free tip, can be reduced to a minimum.

Because the engagement indentation portion 131*c* is formed between the pair of protrusion portions 131*d*, 131*d* and because the engagement protrusion portion 133*e* is detachably engageble therewith, rotation of the sheet-feed roller 104 can be regulated in either the forward or reverse rotational directions using a simple configuration. Also, the left and right guide surfaces 133*f*, 133*g* of the leg portions 133*c*, 133*d* guide rotation of the sheet-feed roller gear 131 so that the engagement indentation portion 131*c* and the engagement spring portion 133*b* can be engaged and disengaged without difficulty.

As shown in FIG. 15, the engagement protrusion portion 133*e* is formed integrally with the leg portion 133*c* at its upper side in the forward rotational direction indicated by the arrow in FIG. 15 and separated from the leg portion 133*d* at its lower side. Therefore, when the protrusion engagement portion 133*e* rides over the protrusion portion 131*d* while the sheet-feed roller gear 131 rotates in its forward rotational direction, the entire spring member 133 needs to bend only slightly for the protrusion engagement portion 133*e* to ride over the protrusion portion 131*d*. However, when the non-connected side of the engagement protrusion portion 133*e*, that is, the side confronting the leg 133*d*, abuts the protrusion portion 131*d* in the reverse rotational direction, the engagement protrusion portion 133*e* will need to bend back upon itself to ride over the protrusion portion 131*d*. Accordingly, the sheet-feed roller 104 will not easily be rotated by its own self-weight or by outside forces.

Figure 20:
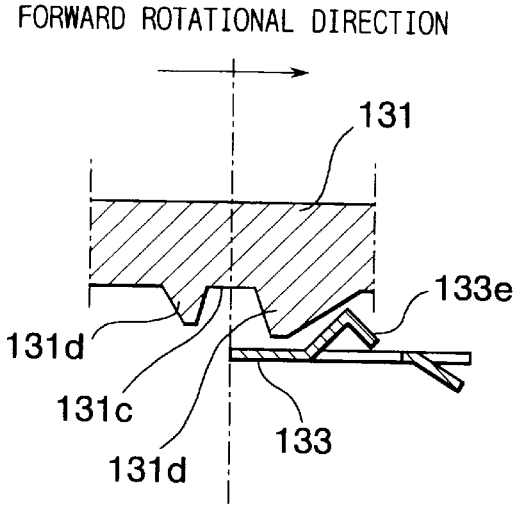
FIG. 20(*a*) is a cross-sectional view showing relationship between the sheet-feed roller gear and the spring member while the drive motor drives in the forward rotational direction.
Figure 20:
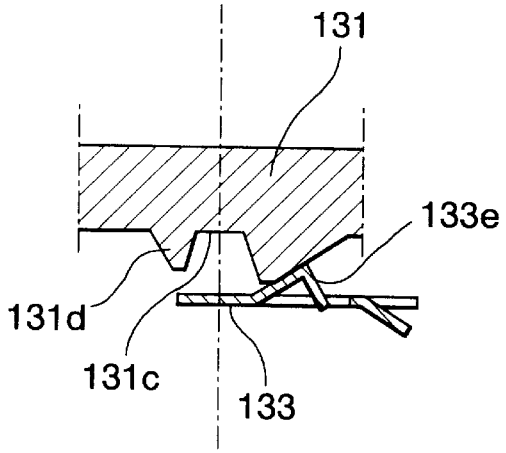
Figure 20:
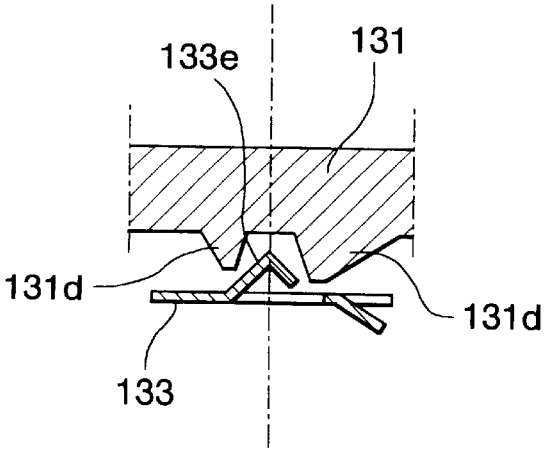

This feature of the present invention will be described here in more detail with reference to FIGS. 20(*a*) to 21(*b*). When the sheet-feed roller gear 131 is rotating in the forward rotational direction as indicated by an arrow in FIG. 20(*a*), the engagement protrusion portion 133*e* will abut against the protrusion portion 131*d* as shown in FIG. 20(*b*). Because the engagement protrusion portion 133*e* is separated from the leg portion 133*d*, it easily bends away from and rides over the protrusion portion 131*d* into engagement with the engagement indentation portion 131*c* as shown in FIG. 20(*c*).

Figure 21:
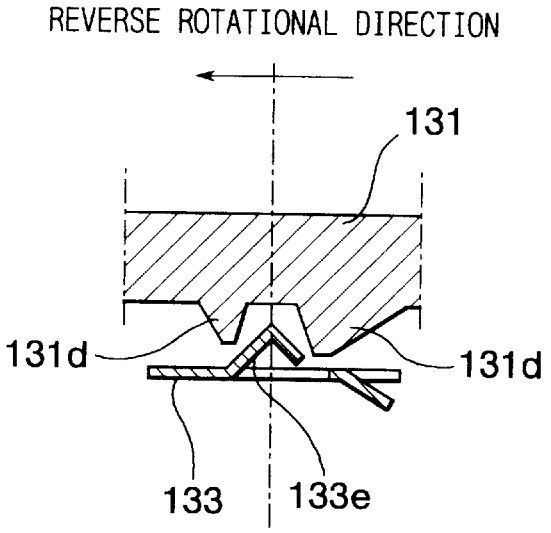
FIG. 21(*a*) is a cross-sectional view showing relationship between the sheet-feed roller gear and the spring member when the sheet-feed roller gear rotates in the reverse rotational direction.
Figure 21:
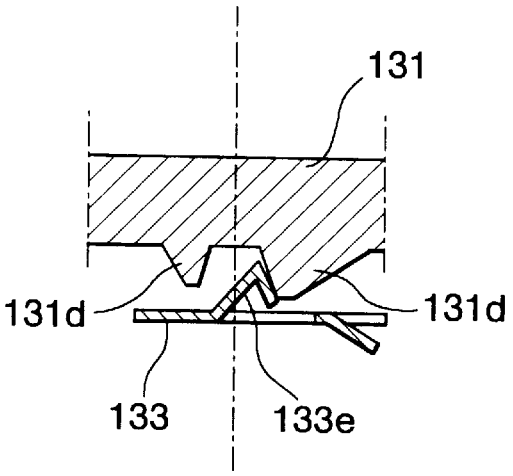

On the other hand, should the sheet-feed roller gear 131 begin rotating in the reverse rotational direction, for example, by self-weight of the sheet-feed roller 104, as indicated by an arrow in FIG. 21(*a*), the engagement protrusion portion 133*e* will abut against and bend to conform with the surface of the same protrusion portion 131*d* as shown in FIG. 21(*b*). Because the engagement protrusion portion 133*e* is attached to the leg portion 133*c* and because it bends to press flat against the protrusion portion 131*d*, it will have to bend back on itself to ride over the protrusion portion 131*d*. Accordingly, the sheet-feed roller 104 will not easily be rotated in the reverse rotational direction by its own self-weight or by outside forces.

In the second embodiment, the spring member 133 is provided for regulating rotation of the sheet-feed roller 104 by pressing against the side surface of the sheet-feed roller gear 131. However, in this case the sheet-feed roller 131 is only resiliently supported by the spring member 133. Therefore, when the planetary gear 129 is in confrontation with the toothless portion 131*a*, and the spring member 133 abuts the tip of the protrusion portion 131*d*, then the sheet-feed roller gear 131 can stop shifted out of phase and be maintained in this incorrect position by the spring member 133.

Figure 22:
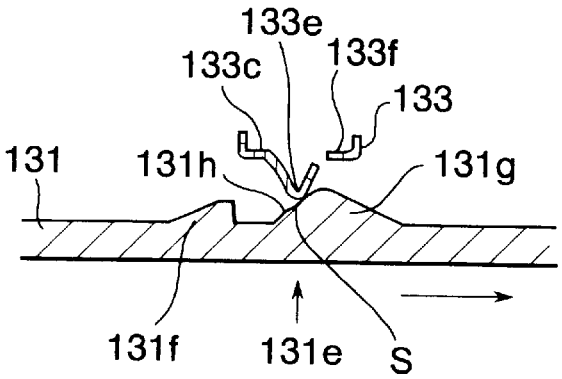
FIG. 22 a side view in partial cross section showing a modification of a sheet-feed device according to the first and the second embodiment.

To prevent this, a slanting surface S shown in FIG. 22 can be formed to the side surface of the sheet-feed roller gear 131 at a position where, even if the sheet-feed roller gear 131 is shifted slightly out of phase, the spring 133 will resiliently press against the slanting surface S and slightly rotate the sheet-feed roller 131 back into its proper stopped condition, wherein the toothless portion 131*a* confronts the first planetary gear 29. The spring 133 will then resiliently maintain the sheet-feed roller 104 in its proper stopped condition.

As shown in FIG. 22, the protrusion portion 131*g*, which the engagement protrusion portion 133*e* rides over directly before the stopped condition, is formed higher than the protrusion portion 131*f*, which the engagement protrusion portion 133*e* rides over directly after start of rotation of the sheet-feed roller 104 from its initial condition. Therefore, even if the sheet-feed roller gear 131 is urged to shift out of phase by vibration and the like, pressure from the spring member 133 will return the sheet-feed roller gear 131 to its predetermined stopped condition by pressing against the slanting surface 131*h* of the protrusion portion 131*g*.

In this way, when the sheet-feed roller gear 131 rotates from the condition shown in FIG. 19 to the condition shown in FIG. 13 and the toothless portion 131 is brought into confrontation with the first planetary gear 129, then the spring member 133 will ride over the higher protrusion portion 131*g* and resiliently press against the slanted surface 131*h*. As a result, the sheet-feed roller gear 131 rotates slightly until the toothless portion 131*a* is brought into complete confrontation with the first planetary gear 129.

It should be noted that this same configuration can be provided to the sheet-feed device of the first embodiment with the same effects. Also, even if the slanted surface is formed to the spring member 133 and the protrusion portion to the sheet-feed roller gear. 131, the same effects can be obtained even if the protrusion portion attempts to abut against the slanted surface.

Next, the sheet-supply device according to a third embodiment of the present invention will be described.

Figure 23:
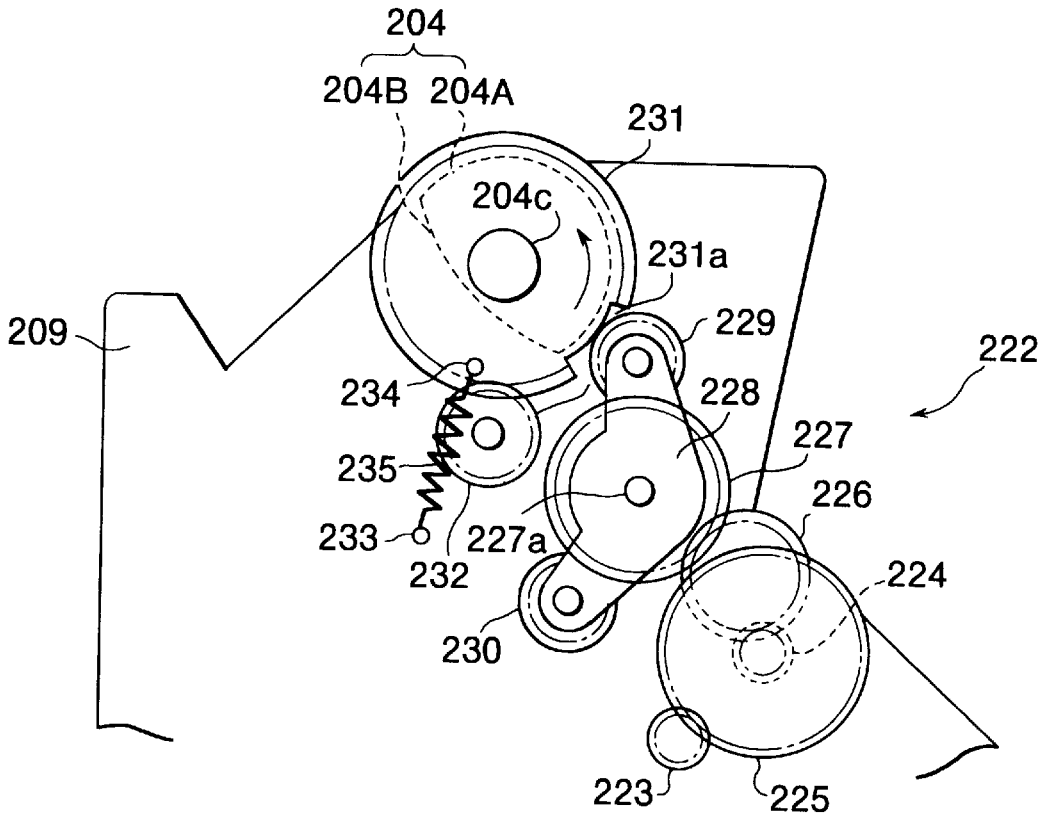
FIG. 23(*a*) is a side view showing a sheet-feed device according to a third embodiment of the present invention.
Figure 23:
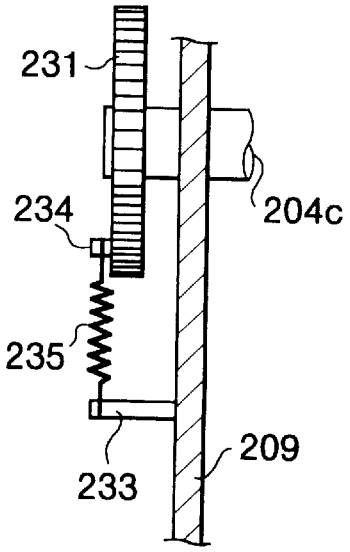
Figure 25:
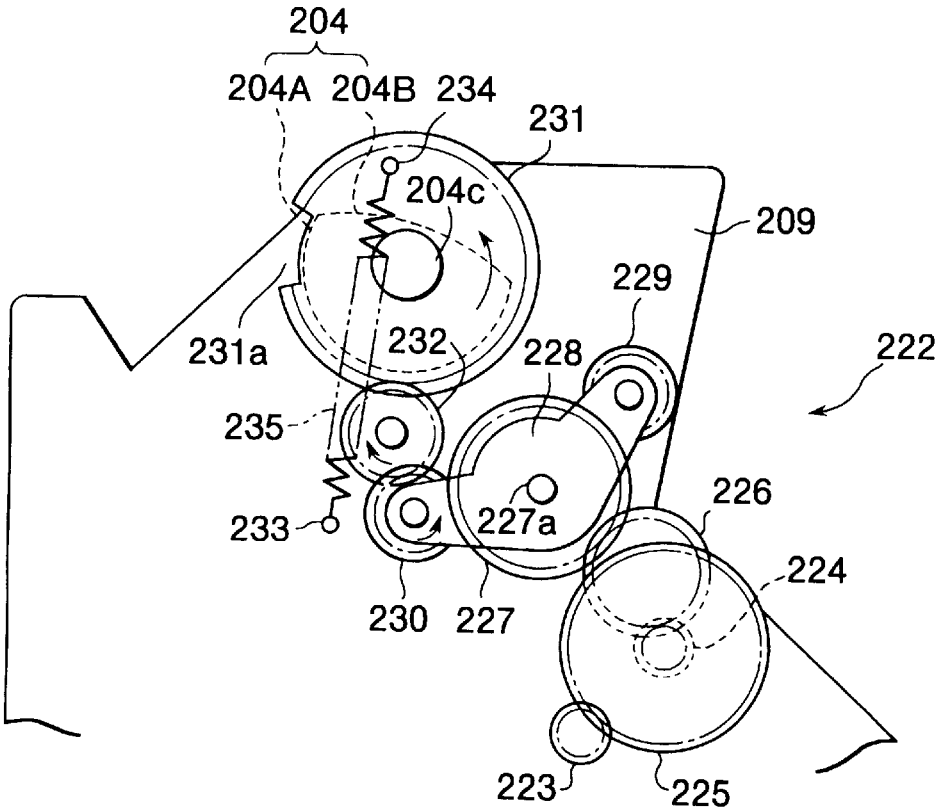
FIG. 25 is a side view showing the sheet-feed device of FIG. 23(*a*) after the drive motor rotates in the reverse direction.

The sheet-supply device according to the third embodiment has a configuration similar to that of those described in the first and the second embodiment. However, as shown in FIG. 23(*a*), the spring hold portion 233, which is a cantilever is provided to the side plate 209 of the print frame 208. A spring hold portion 234, which is a cantilever is provided on the surface of the sheet-feed roller 231 in confrontation with the side plate 209. It should be noted that the spring hold portion 233 and the spring hold portion 234 protrude in the same directions. A spring member 235, which in this embodiment is a pulling coil spring, is disposed between the spring hold portions 234 and 235. The central line of the spring member 235 follows rotation of the sheet-feed roller gear 231, thereby swinging from right to left as viewed in FIG. 25. As shown in FIG. 25, before engagement between the second planetary gear 230 and the sheet-feed roller gear 231 is released in association with the switching of the transport motor from the reverse rotational direction to the forward rotational direction, the center line of the spring member 235 crosses the center of the sheet-feed roller gear 231.

In the initial condition shown in FIGS. 1 and 23(*a*), the sheet-feed roller 204 is positioned so that its non-sheet-feed portion 204B faces the sheet, the second planetary gear 230 is separated from the supplemental gear 232, and the first planetary gear 229 is in opposition with the toothless portion 231*a* of the sheet-feed roller 231. At this time, the spring member 235, the spring hold portions 233, 234, and the center of the sheet-feed roller gear 231 are all aligned on the same imaginary line. Therefore, the spring member 235 does not urge the sheet-feed roller gear 231 to rotate.

Figure 24:
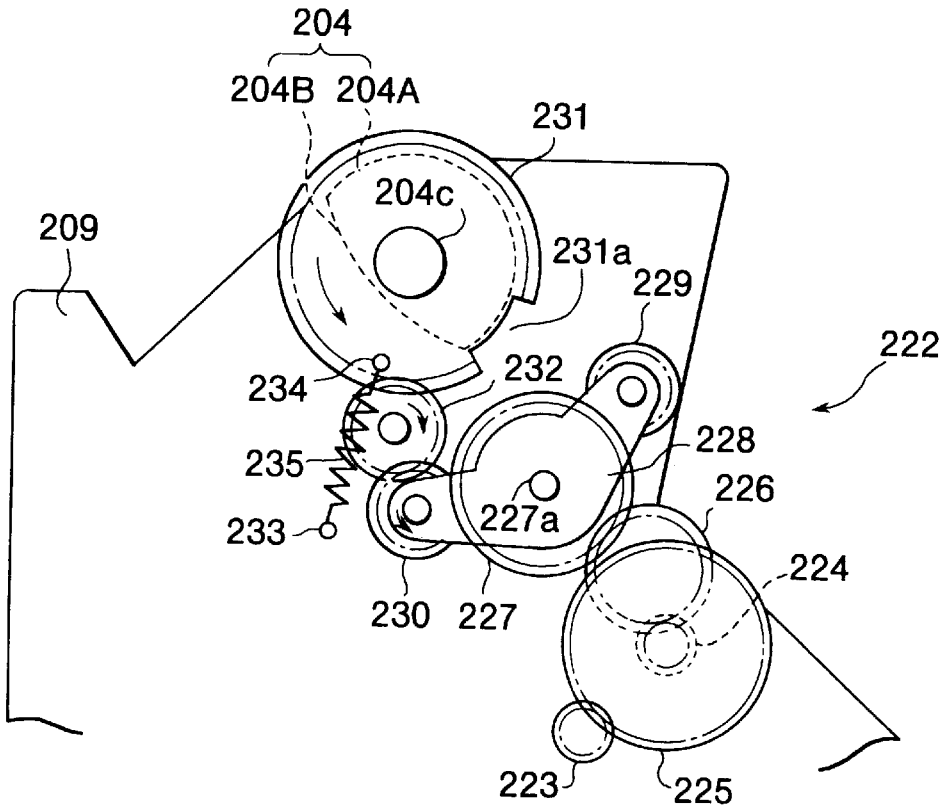
FIG. 24 is a side view showing the sheet-feed device of FIG. 23(*a*) after a drive motor starts rotating in a reverse direction.

When the second planetary gear 230 is brought into engagement with the supplemental gear 232 so that the sheet-feed roller gear 231, and consequently the sheet-feed roller 204, are rotated in the sheet-feed direction, then as shown in FIG. 24, the spring member 235 is stretched against its own resiliency.

Figure 26:
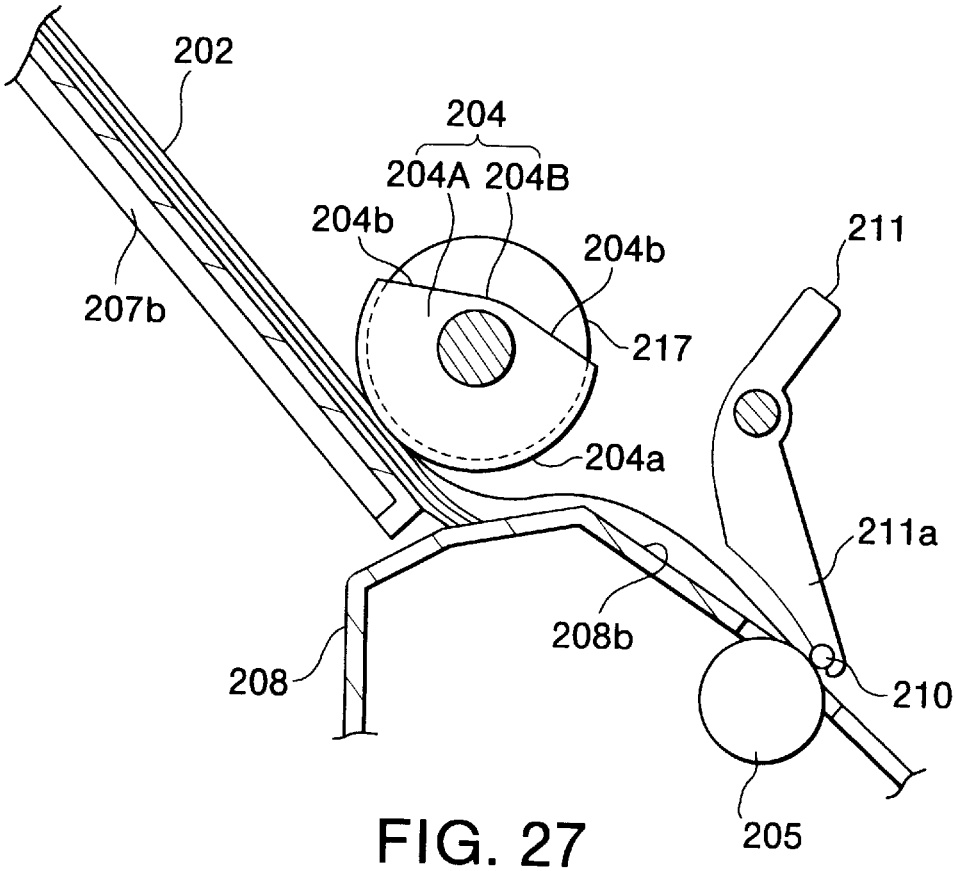
FIG. 26 is a side view showing condition of the sheet-supply device when the sheet-feed device is in the condition shown in FIG. 23(*a*)

When, as shown in FIGS. 25 and 26, the sheet-feed roller 204 is rotated until the sheet 202 reaches the transport roller 205 and bends upward, then the spring hold portion 234 will have crossed over an imaginary line segment connecting the center of the sheet-feed roller gear 231 and the spring hold portion 233. That is, the central line of the spring member 235 will have passed the center of the sheet-feed roller gear 221 so that the pulling force of the spring member 235 urges the sheet-feed roller gear 231 to rotate counterclockwise as viewed in FIG. 25.

Figure 27:
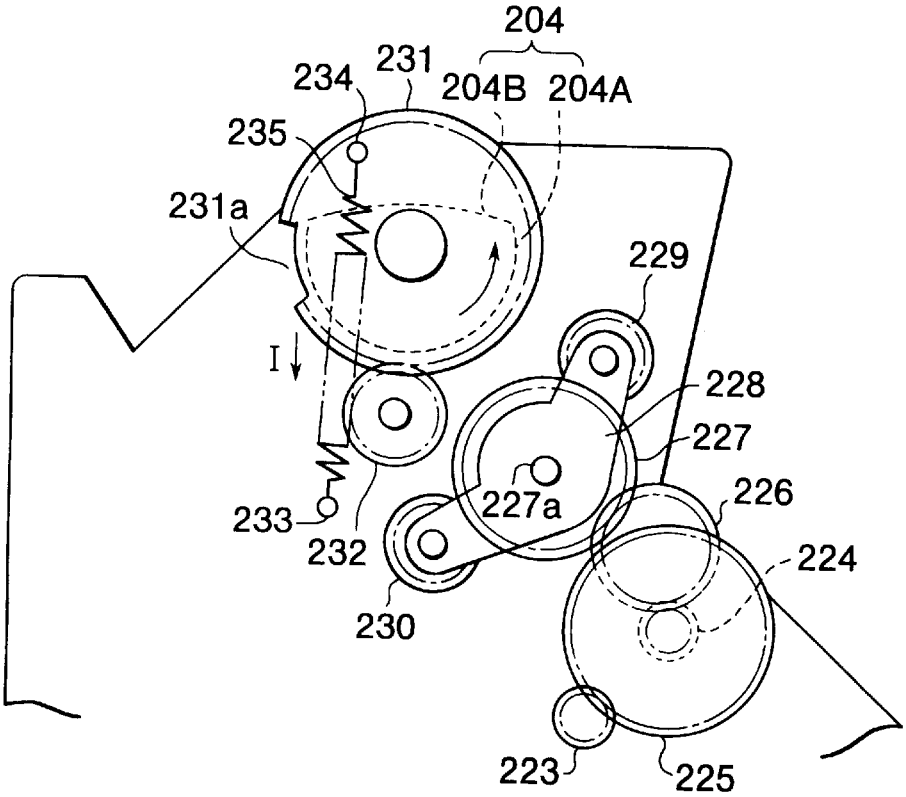
FIG. 27 is a side view showing the sheet-feed device of FIG. 23(*a*) when rotational direction of the drive motor switches to forward rotation.
Figure 28:
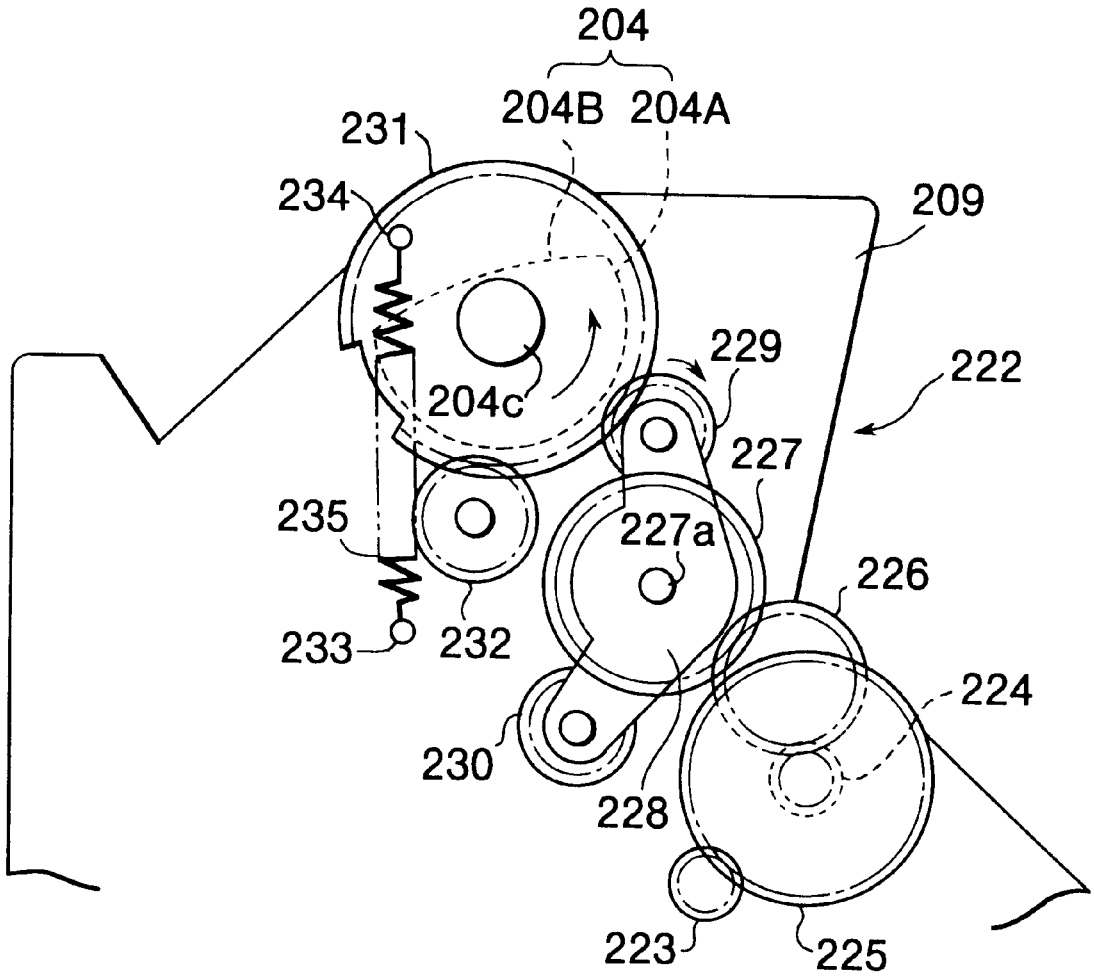
FIG. 28 is a side view showing the sheet-feed device of FIG. 23(*a*) after rotational direction of the drive motor switches to forward rotation.

When the drive gear 223 then starts to rotate in the forward rotational direction, then the base plate 228 rotates counterclockwise as viewed in FIG. 27 so that engagement between the second planetary gear 30 and the supplemental gear 232 is released. Then, as shown in FIG. 28, the first planetary gear 229 is brought into direct engagement with the sheet-feed roller gear 231. It should be noted that between the time when engagement between the second planetary gear 230 and the supplemental gear 232 is released and when the first planetary gear 229 engages the sheet-feed roller gear 231, urging force I of the spring member 235 urges the sheet-feed roller gear 231 to rotate in the direction for feeding the sheet 202 as indicated in FIG. 27. Therefore, the sheet-feed roller 204 continues to rotate so that sheet-feed processes can be continued.

Engagement of the first planetary gear 229 and the sheet-feed roller gear 231 rotates the sheet-feed roller gear 231 further until the sheet-feed roller 204 has rotated one complete turn so that the first planetary gear 229 has stopped in confrontation with the toothless portion 231*a*. The sheet-feed roller 204 will be in its initial condition and capable of supplying a subsequent sheet 202. Because the first planetary gear 229 is in opposition with the toothless portion 231*a* in the initial condition. The sheet-feed roller 204 can be stopped at a fixed initial condition each time because rotation caused by the spring member 235 will not engage the first planetary gear 229 with the sheet-feed roller gear 231.

In this way, sheets are consecutively fed out of the sheet-supply cassette 207 one at a time and then transported at a set pitch by the transport roller 205 toward the printing mechanism.

With the configuration described in the third embodiment, from when the engagement between the second planetary gear 230 and the sheet-feed roller gear 231 is released until when the first planetary gear 229 engages with the sheet-feed roller gear 231, drive force from the step motor 219 is not transmitted to the sheet-feed roller gear 231. However, the spring member 235 urges the sheet-feed roller gear 231 to continue rotating in the direction required for sheet-feed of the sheet 202. Therefore, the sheet-feed roller 204 is forced to continue rotating so that sheet-feed is continued. Because the sheet-feed roller 204 is forced to rotate in this manner, regardless of whether the sheet 202 is thick or thin, the sheet-feed roller 204 will not be rotated backward by stiffness of the sheet 202. Therefore, sheet-feed will continue smoothly even during the interval when rotational direction of the stepping motor 19 is switched from the reverse rotational direction to the forward rotational direction.

As described above, the spring member 235 is provided so that its central line moves passed the center of the sheet-feed roller 204. With this simple configuration, when rotational direction of the step motor switches from the reverse rotational direction to the forward rotational direction so that engagement between the second planetary gear 230 and the sheet-feed roller gear 231 is released, rotation of the sheet-feed roller 204 for transporting the sheet 202 can be continued.

In the first, second, and third embodiments, a single supplemental gear was disposed between the second planetary gear and the sheet-feed roller gear as opposed to no gears being disposed between the first planetary gear and the sheet-feed roller gear. However, the number of supplemental gears disposed between the second planetary gear and the sheet-feed roller gear is not limited to one gear. However, to insure that the sheet-feed roller gear continuously rotates in the direction of feeding sheets, the number of supplemental gears disposed between the second planetary gear and the sheet-feed roller gear should be odd number greater than the number of gears disposed between the first planetary gear and the sheet-feed roller gear. For example, if one gear is disposed between the first planetary gear and the sheet-feed roller gear, then two gears should be disposed between the second planetary gear and the sheet-feed roller gear.

While the invention has been described in detail with reference to specific embodiments thereof, it would be apparent to those skilled in the art that various changes and modifications may be made therein without departing from the spirit of the invention, the scope of which is defined by the attached claims.

For example, although the hopper containing stack sheets was described in the first through third embodiments as being detachable by detachably mounting the sheet supply cassette to the engagement indentation portion of the print frame, the hopper storing the stacked sheets can be formed directly to the printer frame and be a fixed type hopper.

What is claimed is:

1. A sheet-supply device for supplying a sheet from a stack of sheets to a print mechanism, the sheet-supply device comprising:

a sheet-feed roller for rotating in a sheet-feed rotational direction for feeding, in a sheet-feed direction, the sheet from the stack of sheets;

a rotatable transport roller disposed downstream from the sheet-feed roller in the sheet-feed direction;

a drive source for generating a drive force by rotating in a forward rotational direction to rotate the transport roller in a sheet-transport rotational direction for transporting the sheet away from the sheet-feed roller and a reverse rotational direction to rotate the transport roller in a reverse sheet-transport rotational direction opposite the sheet-transport rotational direction;

a drive force transmission mechanism for transmitting drive force from the drive source to the sheet-feed roller to rotate the sheet-feed roller in the sheet-feed rotational direction, the drive force transmission mechanism interrupting transmission of drive force from the drive source to the sheet-feed roller for a short period when the drive source switches from its reverse rotational direction to its forward rotational direction and for a long period longer than the short period when the drive source switches from its forward rotational direction to its reverse rotational direction, wherein the drive force transmission mechanism includes:

a sun gear driven by the drive source;

a sheet-feed gear connected to rotate with the sheet-feed roller;

a first planetary gear and a second planetary gear in meshing engagement with the sun gear and pivotable around the sun gear, the first planetary gear pivoting a first pivot range into driving connection with the sheet-feed gear when the drive source is driven in the forward rotational direction and the second planetary gear pivoting a second pivot range into driving connection with the sheet-feed gear when the drive source is driven in the reverse rotation direction, the first pivot range being shorter than the second pivot range, the first and second planetary gears capable of pivoting independently from each other around the sun gear; and further comprising:

an urging means for urging the first planetary gear into driving engagement with the sheet-feed roller, the sheet-feed roller has a sheet-feed portion for contacting the sheet and a non-sheet-feed portion with a shorter radius than the sheet-feed portion; and the sheet-feed gear has a first gear portion for drivingly connecting with the first planetary gear and a second gear portion for drivingly connecting with the second planetary gear, the first gear portion having a toothless portion at a portion thereof that confronts the first planetary gear when the non-sheet-feed portion of the sheet-feed roller confronts the sheet.

2. A sheet-supply device as claimed in claim 1, wherein the drive force transmission mechanism includes a further gear for transmitting drive force from the drive source via the second planetary gear to the sheet-feed roller to drive the sheet-feed roller in the sheet-feed rotational direction when the drive force rotates in the forward rotational direction and in the reverse rotational direction.

3. A sheet-supply device as claimed in claim 1, wherein the toothless portion of the first gear portion is formed larger than a portion of the first gear portion corresponding to the non-sheet-feed portion of the sheet-feed roller.

4. A sheet-supply device as claimed in claim 1, wherein the toothless portion of the first gear portion is formed to correspond to the non-sheet-feed portion and a portion of the sheet-feed portion of the sheet-feed roller.

5. A sheet-supply device as claimed in claim 1, further comprising a cam for separating the first planetary gear from the sheet-feed gear against the urging force of the urging means when the second planetary gear is in driving connection with the sheet-feed gear.

6. A sheet-supply device as claimed in claim 5, further comprising a plate member supporting the first planetary gear rotatable around the sun gear; and wherein the cam includes a protrusion portion provided to a side surface of the sheet-feed gear and for pressing the plate member and the first planetary gear away from the sheet-feed gear.

7. A sheet-supply device as claimed in claims 1, further comprising a print head for performing printing operations on the sheet and disposed downstream from the transport roller in the sheet-transport rotational direction.

8. A sheet-supply device as claimed in claim 7, wherein the print head is an ink jet print head for ejecting ink droplets toward the sheet.

9. A sheet-supply device for supplying a sheet from a stack of sheets to a print mechanism, the sheet-supply device comprising:

a sheet-feed roller for rotating in a sheet-feed rotational direction for feeding, in a sheet-feed direction, the sheet from the stack of sheets;

a rotatable transport roller disposed downstream from the sheet-feed roller in the sheet-feed direction;

a drive source for generating a drive force by rotating in a forward rotational direction to rotate the transport roller in a sheet-transport rotational direction for transporting the sheet away from the sheet-feed roller and a reverse rotational direction to rotate the transport roller in a reverse sheet-transport rotational direction opposite the sheet-transport rotational direction;

a drive force transmission mechanism for transmitting drive force from the drive source to the sheet-feed roller to rotate the sheet-feed roller in the sheet-feed rotational direction, the drive force transmission mechanism interrupting transmission of drive force from the drive source to the sheet-feed roller for a short period when the drive force switches from its reverse rotational direction to its forward rotational direction and for a long period longer than the short period when the drive force switches from its forward rotational direction to its reverse rotational direction, wherein the drive force transmission mechanism includes:

a sun gear driven by the drive source;

a sheet-feed gear connected to rotate with the sheet-feed roller;

a first planetary gear and a second planetary gear in meshing engagement with the sun gear and pivotable around the sun gear, the first planetary gear pivoting a first pivot range into driving connection with the sheet-feed gear when the drive source is driven in the forward rotational direction and the second planetary gear pivoting a second pivot range into driving connection with the sheet-feed gear when the drive source is driven in the reverse rotation direction, the first pivot range being shorter than the second pivot range, and the first and second planetary gears capable of pivoting independently from each other around the sun gear; and further comprising an urging means for urging the first planetary gear into driving engagement with the sheet-feed roller.

10. A sheet-supply device as claimed in claim 9, wherein:

the sheet-feed roller has a sheet-feed portion for contacting the sheet and a non-sheet-feed portion with a shorter radius than the sheet-feed portion; and the sheet-feed gear has a first gear portion for drivingly connecting with the first planetary gear and a second gear portion for drivingly connecting with the second planetary gear, the first gear portion having a toothless portion at a portion thereof that confronts the first planetary gear when the non-sheet-feed portion of the sheet-feed roller confronts the sheet.

11. A sheet-supply device as claimed in claim 9, wherein at least one gear of the first and second planetary gears transmits drive force from the drive source to the sheet-feed roller to drive the sheet-feed roller in the sheet-feed rotational direction when the drive force rotates in the forward rotational direction and in the reverse rotational direction.

12. A sheet-supply device for supplying a sheet from a stack of sheets to a print mechanism, the sheet supply device comprising:

a sheet-feed roller for rotating in a sheet-feed rotational direction for feeding, in a sheet-feed direction, the sheet from the stack of sheets;

a rotatable transport roller disposed downstream from the sheet-feed roller in the sheet-feed direction;

a drive source for generating a drive force by rotating in a forward rotational direction to rotate the transport roller in a sheet-transport rotational direction for transporting the sheet away from the sheet-feed roller and a reverse rotational direction to rotate the transport roller in a reverse sheet-transport rotational direction opposite the sheet-transport rotational direction;

a drive force transmission mechanism for transmitting drive force from the drive source to the sheet-feed roller to rotate the sheet-feed roller in the sheet-feed rotational direction, the drive force transmission mechanism interrupting transmission of drive force from the drive source to the sheet-feed roller for a short period when the drive force switches from its reverse rotational direction to its forward rotational direction and for a long period longer than the short period when the drive force switches from its forward rotational direction to its reverse rotational direction, wherein the drive force transmission mechanism includes:

a sun gear driven by the drive source;

a sheet-feed gear connected to rotate with the sheet-feed roller;

a first planetary gear and a second planetary gear in meshing engagement with the sun gear and pivotable around the sun gear, the first planetary gear pivoting a first pivot range into driving connection with the sheet-feed gear when the drive source is driven in the forward rotational direction and the second planetary gear pivoting a second pivot range into driving connection with the sheet-feed gear when the drive source is driven in the reverse rotation direction, the first pivot range being shorter than the second pivot range, and the first and second planetary gears are capable of pivoting independently from each other around the sun gear; and further comprising a cam rotating in association with the sheet-feed gear and for separating the first planetary gear from the sheet-feed gear when the second planetary gear is drivingly connected with the sheet-feed gear.

13. A sheet-supply device as claimed in claim 12, wherein at least one gear of the first and second planetary gears transmits drive force from the drive source to the sheet-feed roller to drive the sheet-feed roller in the sheet-feed rotational direction when the drive force rotates in the forward rotational direction and in the reverse rotational direction.

14. A sheet-supply device as claimed in claim 12, further comprising a print head for performing printing operations on the sheet and disposed downstream from the transport roller in the sheet-transport rotational direction.

15. A sheet-supply device as claimed in claim 14, wherein the print head is an ink jet print head for ejecting ink droplets toward the sheet.

* * * * *